US010337528B2

(12) United States Patent
Rivera

(10) Patent No.: US 10,337,528 B2
(45) Date of Patent: Jul. 2, 2019

(54) DETACHABLE FAN SYSTEMS

(71) Applicant: Anthony Rivera, Huntington Beach, CA (US)

(72) Inventor: Anthony Rivera, Huntington Beach, CA (US)

( * ) Notice: Subject to any disclaimer, the term of this patent is extended or adjusted under 35 U.S.C. 154(b) by 397 days.

(21) Appl. No.: 15/078,834

(22) Filed: Mar. 23, 2016

(65) Prior Publication Data

US 2016/0281742 A1 Sep. 29, 2016

Related U.S. Application Data

(60) Provisional application No. 62/137,027, filed on Mar. 23, 2015.

(51) Int. Cl.

| | |
|---|---|
| ***F04D 29/60*** | (2006.01) |
| ***F04D 25/06*** | (2006.01) |
| ***F04D 25/08*** | (2006.01) |

(52) U.S. Cl.

CPC ..... *F04D 29/601* (2013.01); *F04D 25/0673* (2013.01); *F04D 25/08* (2013.01)

(58) Field of Classification Search

CPC .... F04D 29/626; F04D 29/646; F04D 29/602; F04D 29/606; F04D 29/601; F04D 25/06; F04D 25/08; F04D 25/0673; F16B 21/04

See application file for complete search history.

(56) References Cited

U.S. PATENT DOCUMENTS

| | | | | |
|---|---|---|---|---|
| 3,569,907 | A * | 3/1971 | Landgraf | H01K 1/46 439/336 |
| 3,860,404 | A * | 1/1975 | Jochimski | B01D 46/10 131/238 |
| 5,087,213 | A * | 2/1992 | Drapcho | H01R 33/9655 439/336 |
| 6,095,767 | A | 8/2000 | Caughey | |
| 6,179,564 | B1 | 1/2001 | Park | |
| 6,217,294 | B1 * | 4/2001 | Arnieri | A45F 3/16 222/135 |
| 6,409,475 | B1 * | 6/2002 | Ho | F04D 25/06 248/314 |
| 6,556,437 | B1 * | 4/2003 | Hardin | H05K 7/20172 361/679.48 |
| 8,235,686 | B2 | 8/2012 | Wark | |
| 9,334,872 | B2 * | 5/2016 | Wark | F04D 25/0673 |
| 2004/0012289 | A1 * | 1/2004 | Gross | F04D 29/626 310/91 |

(Continued)

*Primary Examiner* — Charles G Freay
*Assistant Examiner* — Thomas Fink
(74) *Attorney, Agent, or Firm* — Mohr Intellectual Property Law Solutions, PC

(57) ABSTRACT

Various embodiments of the present invention include fan systems for moving air within a room. In some embodiments, the fan systems described herein can be attached to a base that can be mounted on a ceiling, wall, or other building structure. In some embodiments, a single fan may be attached to a first base at a first location for a period of time, and subsequently detached from the first base and attached to another base at another location. In some embodiments, the fan system includes a rechargeable battery, so that the base does not need to be connected to or associated with a power source in order for the fan to operate. Some embodiments of the invention include modular charging systems for electronic devices.

20 Claims, 14 Drawing Sheets

(56) References Cited

U.S. PATENT DOCUMENTS

| | | | | |
|---|---|---|---|---|
| 2007/0129002 | A1* | 6/2007 | Barrett | E04H 1/1216 454/343 |
| 2008/0069694 | A1 | 3/2008 | Hernandez et al. | |
| 2008/0152482 | A1* | 6/2008 | Patel | F04B 17/006 415/121.3 |
| 2012/0039063 | A1* | 2/2012 | Chao | F21S 9/022 362/20 |
| 2012/0318393 | A1* | 12/2012 | Tsen | F15D 1/02 137/803 |
| 2014/0112791 | A1* | 4/2014 | Abell | F04D 25/084 416/159 |
| 2015/0044519 | A1* | 2/2015 | Rief | H01M 10/613 429/50 |
| 2018/0038376 | A1* | 2/2018 | Swaney | F04D 25/084 |

* cited by examiner

DETACHABLE FAN SYSTEMS

CROSS-REFERENCE TO RELATED APPLICATIONS

This application claims priority under 35 U.S.C. § 119(e) to U.S. Provisional Patent Application No. 62/137,027, filed Mar. 23, 2015, the contents of which are herein incorporated by reference in its entirety.

FIELD OF THE INVENTION

The present invention generally relates to fan systems for moving air.

BACKGROUND

The following description includes information that may be useful in understanding the present invention. It is not an admission that any of the information provided herein is prior art or relevant to the presently claimed invention.

There are numerous systems and devices available for cooling a space by moving air, including many types of air conditioning systems and fans. While air conditioning systems can be effective in reducing the temperature of air within a building structure, most aren't particularly energy or cost efficient, because they rely upon a central cooling unit with conduits that distribute cool air throughout a structure. Although the flow of air can be managed somewhat, it can be difficult to selectively cool one room within a building structure without wasting energy in the process, partly because of the coordination required between one or more thermostat and the central cooling unit, and the fact that even the minimum power requirements for a central air system to selectively cool a single room are significant. As an alternative, traditional window mounted air conditioning units can be employed, but have a limited capacity to cool beyond their immediate surroundings, and aren't usually very effective at cooling more than one large room. Ceiling fans provide a more cost effective alternative to central air conditioning systems and wall mounted units, however, like wall mounted systems, they have a limited capacity to cool, and are not especially effective at cooling by circulating air beyond a single room. Additionally, it is often the case that not every room in a structure includes wiring for a ceiling fan. Floor fans, including oscillating floor fans, are another form of air circulating device that, like ceiling mounted fans, are relatively limited in operation to cooling a single room or portion thereof, depending upon the size of the room. Because most floor fans do not provide enough air circulating capacity to cool multiple rooms, they are often moved relatively frequently to different rooms. Certain floor fans are hazardous to small children and pets, and must be frequently moved for that reason, and therefore repeatedly plugged into and unplugged from one or more wall outlet.

There is clearly a need in the art for devices and systems that provide a safe, convenient, efficient, effective and esthetically pleasing way of moving air in a selected room for the purpose of cooling and/or improving air circulation in the room.

There is also a need for modular systems that allow for (1) charging an electrically powered device that includes a rechargeable battery at one location/docking station, and (2) subsequently positioning/docking the charged electrically powered device at another location/docking station in which there is no connection to electricity available.

SUMMARY OF THE INVENTION

In various embodiments, the present invention teaches a modular fan system that includes an air displacing component; and a fan docking station, wherein the air displacing component is removably attached to the fan docking station. In some embodiments, the modular fan system further comprises a fan base removably or permanently connected to the fan docking station, wherein the fan base is configured to be attached to a building structure. In some embodiments, the fan docking station is a fan mount. In some embodiments, the fan docking station is a floor base. In some embodiments, the modular fan system further includes a rechargeable battery electrically connected to a motor that drives the air displacing component. In certain embodiments, the fan docking station is configured to charge the rechargeable battery. In certain embodiments, the fan docking station (1) is connected to a source of electricity, and (2) provides electricity to the motor. In some embodiments, the air displacing component is bladeless. In certain embodiments, the air displacing component includes a fan blade. In certain embodiments, the air displacing component is wedge-shaped. In various embodiments, the air displacing component is removably attached to the fan docking station via two spring loaded wedges that are lodged in the fan docking station In some embodiments, the air displacing component is removably attached to the fan docking station via two post-shaped electrical contacts that are lodged in two complimentary channels in the fan docking station.

In various embodiments, the invention teaches an apparatus that includes an elongated electrically powered device that includes a rechargeable battery; and a docking station, wherein the docking station is removably attached to the elongated electrically powered device. In certain embodiments, the docking station is configured to charge the rechargeable battery of the elongated electrically powered device. In some embodiments, the apparatus further includes a base removably or permanently connected to the docking station, wherein the base is configured to be attached to a building structure. In certain embodiments, the building structure is a ceiling. In some embodiments, the elongated electrically powered device is removably attached to the docking station via two spring loaded wedges that are lodged in the docking station In certain embodiments, the elongated electrically powered device is removably attached to the docking station via two post-shaped electrical contacts that are lodged in two complimentary channels in the docking station.

BRIEF DESCRIPTION OF THE DRAWINGS

Exemplary embodiments are illustrated in the referenced figures. It is intended that the embodiments and figures disclosed herein are to be considered illustrative rather than restrictive.

DETAILED DESCRIPTION OF THE INVENTION

All references cited herein are incorporated by reference in their entirety as though fully set forth. Unless defined otherwise, technical terms used herein have the same meaning as commonly understood by one of ordinary skill in the art to which this invention belongs. One skilled in the art will recognize many methods and materials similar or equivalent to those described herein, which could be used in the practice of the present invention. Indeed, the present invention is in no way limited to the methods and materials specifically described.

In some embodiments, properties such as dimensions, shapes, relative positions, and so forth, used to describe and claim certain embodiments of the invention are to be understood as being modified by the term "about."

As used herein, the term "electrical connector" means electrical contact capable of conducting electricity (e.g. AC contact).

Certain features are common to many of the various embodiments of fan devices and fan systems described herein, including (1) a fan mount (e.g. ceiling mount) or base (e.g. floor base), (2) a fan connecting component, (3) a fan midsection, and (4) an air circulating component/section. The term "fan docking station" as used herein means a component that is configured to mate with a fan connecting component. Thus, in various embodiments, a fan docking station is a ceiling mount or a floor base. In some embodiments the "fan midsection" terminates in the air circulating section at or near a first end, and a fan connecting section (configured to mate with a ceiling mount or floor base) at a second end. In various embodiments, two or more of the aforementioned features allow for a modular fan system that can be utilized to removably attach the various fan devices described herein to various structures associated with the inside or outside of a building (e.g., a wall, a ceiling, a floor, a window, a pole, a patio, a roof, a column, etc.) through an appropriate mount and/or base (as described in greater detail herein below). Embodiments of the invention include the systems of multiple interacting components described herein, as well as the individual components/sections. In other words, although various combinations of the individual components (e.g., fan mount, base, connecting components, air circulating components, and complete fan device) can be connected together or otherwise associated with one another to form a variety of modular fan systems (e.g., the systems depicted in the referenced figures and described herein), the individual components are also separate embodiments of the invention.

Fan Mount and Base

Figures 1A, 1B, 1C, 1D:
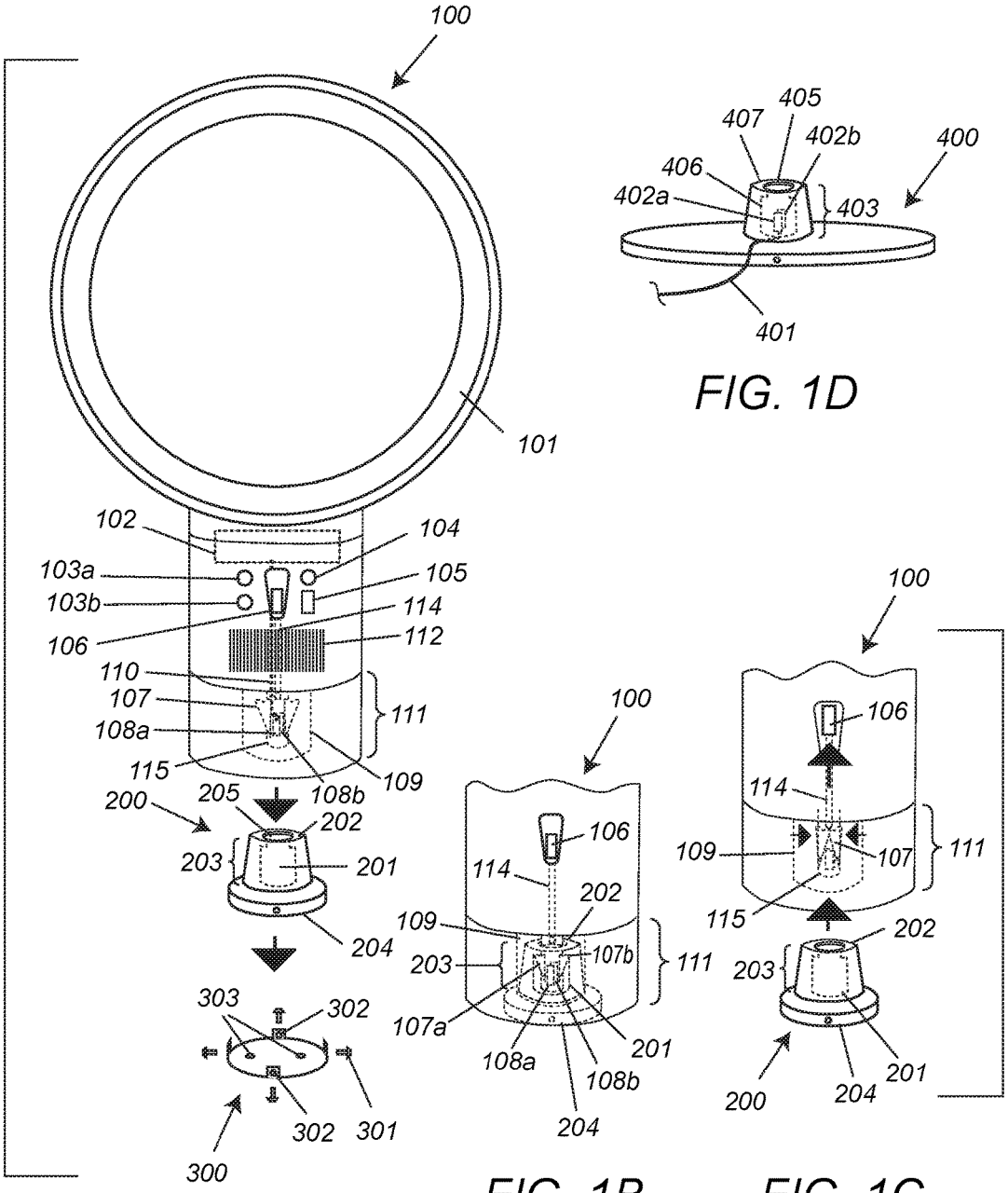
FIG. 1A depicts, in accordance with an embodiment of the invention, bladeless fan device 100, which is placed over ceiling mount 200, which is in turn connected to ceiling base 300. Bladeless fan device 100 operates through direct current (DC) supplied by rechargeable battery 102 when mounted to the ceiling through ceiling mount 200, and is charged by alternating current (AC) from a wall source when mounted on the floor through floor base 400 (FIG. 1D).
FIG. 1B depicts, in accordance with an embodiment of the invention, bladeless fan device 100 connected to ceiling mount 200.
FIG. 1C depicts, in accordance with an embodiment of the invention, bladeless fan device 100 as it is being removed from ceiling mount 200. As lever 106 is moved in the direction indicated by the arrow, it retracts wedges 107*a* and 107*b* into slits of cylinder 115.
FIG. 1D depicts, in accordance with an embodiment of the invention, floor base 400 (connected to a source of electricity (not shown)), which is designed to mate with bladeless fan device 100, and thereby charge rechargeable battery 102 of bladeless fan device 100.

In various embodiments, the fan bases of the fan systems described herein are configured to facilitate mounting of the various fan devices to a building structure, or an object associated therewith. The fan base (floor base, ceiling base, etc.) can be utilized in conjunction with a fan mount (ceiling mount, wall mount, etc.), as demonstrated by the interaction between ceiling base 300 and ceiling mount 200 depicted in FIG. 1A. In some embodiments, the fan base and fan mount can be integrated into a single component, by permanently connecting the two sections together. The fan base can be any of a number of shapes and dimensions, depending upon the nature and shape of the structure to which it is intended to be attached, and the fan mount with which it is intended to mate. In some embodiments, the fan base is approximately circular, and it includes one or more holes designed to accommodate one or more screws, nails, or other fastening elements. Merely by way of non-limiting example, FIG. 1A depicts ceiling base 300 with screws 301 and screw holes 302. In some embodiments, the fan base is configured to be attached to the aforementioned structures through the use of hooks or other fastening components. In other embodiments, the fan base is configured to be attached to a structure through one or more elements that can include, but are in no way limited to, adhesive (permanent or temporary), Velcro, rivets, sliding locks, tongue and groove components, nails, screws, combinations thereof, or any other mechanism for attachment known in the art.

As indicated above, in some embodiments the fan base is designed to be associated with (i.e. permanently or removably connected to) a fan mount, which is in turn designed to be associated with (i.e. permanently or removably connected to) a fan connecting component/section, including, but not limited to, any type of fan connecting component/section described herein and/or depicted in the referenced drawings. Merely by way of non-limiting example, the fan mount may include a socket/receiving section suitable for receiving the end of a fan connecting component. FIGS. 1A-1C depict one such configuration, in which cylindrical component 201 of ceiling mount 200 is configured to receive wedge housing component/section 115 of bladeless fan 100. In the configuration shown in FIGS. 1A-1C cylinder 109 of bladeless fan device 100 fits over narrow section 203 of ceiling mount 200. Alternatively, the fan mount (for example a cylindrically shaped fan mount) may be configured to mate with a socket of a fan connecting component. The socket/receiving section of the fan mount may be any suitable shape for receiving the complimentary end of a fan connecting component/section described herein or otherwise, including cylindrical, square, triangular, etc. The socket/receiving component of the fan mount may be configured to receive wedge locking components of a fan connecting section/component, thereby forming a wedge locking system. An exemplary embodiment of a wedge locking system is depicted in FIGS. 1A-1C. As shown in FIGS. 1A-1C as cylinder 109 of bladeless fan device 100 is placed over ceiling mount 200, spring loaded retracting wedges 107*a* and 107*b* are pushed into slits of wedge housing cylinder 115. Once cylinder 115 is fully inserted through cylindrical opening 205 of ceiling mount 200, the edges of wedges 107*a* and 107*b* that are parallel to rim 202 prevent bladeless fan device 100 from releasing from ceiling mount 200, because they are stopped by narrower inner rim 202 of ceiling mount 200. Bladeless fan device 100 can be removed from ceiling mount 200 by sliding fan release lever 106 (as shown in FIG. 1C), which is operably connected to wedges 107*a* and 107*b* through connecting line 114, thereby causing wedges 107*a* and 107*b* to retract into cylinder 115, so that wedges 107*a* and 107*b* do not interact with (i.e. are not stopped by) inner rim 201 as bladeless fan device 100 is separated from ceiling base 200 (FIG. 1C).

In alternative embodiments, the fan mount can be configured with channels and sockets to accommodate electrical connectors positioned on posts (also referred to herein as "post-shaped electrical connectors") of the fan connecting component. One non-limiting example of this arrangement is depicted in FIG. 3, in which ceiling mount 800 includes channels 801*a* and 801*b* which are shaped to accommodate post-shaped electrical connectors 708*a* and 708*b* of bladeless fan device 700. Post-shaped electrical connectors 708*a* and 708*b* are positioned in ceiling mount 800 by advancing connecting section 711 and internally located cylinder 709 of bladeless fan device 700 over ceiling mount 800, such that post-shaped electrical connectors 708*a* and 708*b* glide along the straight section of channels 801. Bladeless fan device 700 is then twisted clockwise relative to ceiling mount 800 (FIG. 3C) until post-shaped electric connectors 708*a* and 708*b* are positioned in the portions of channels 801*a* and 801*b* that extend toward the narrow end of ceiling mount 800. By positioning post-shaped Electric connectors 708*a* and 708*b* in this way, when ceiling mount 800 is positioned on the ceiling of a building structure (e.g. by connecting ceiling mount 800 to ceiling base 300, which has in turn been fastened to the ceiling), posts 708*a* and 708*b* of bladeless fan device 700 rest in the portions of channels 801*a* and 801*b* that extend toward the narrow end of ceiling mount 800 (and also extend in the direction of the floor). Thus, bladeless fan device 700 can be securely connected to ceiling mount 800, and indirectly to the ceiling. As shown in FIG. 3, bladeless fan device 700 can be removed from ceiling mount 800 by twisting counter clockwise, so that post-shaped Electric connectors 708*a* and 708*b* are situated in the elongated straight portions of channels 801*a* and 801*b*. Once post-shaped Electric connectors 708*a* and 708*b* are positioned in this way, bladeless fan device 700 can be separated from ceiling mount 800 (by pulling, or the force of gravity when ceiling mount 800 is mounted on the ceiling). Although the aforementioned specific embodiments of locking systems are represented in the referenced figures, they are in no way intended to be limiting. One of skill in the art would readily appreciate that many different types of locking systems could be utilized to create modular fan systems without departing from the spirit of the invention, and thus such locking systems are intended to be within the scope of the invention.

In some embodiments, the fan mount and/or base (e.g., ceiling mount and floor base) with which the fan device is intended to connect, includes one or more conduits, channels, holes, or other suitable structures through or in which electrical wiring configured to be connected to a power supply may be placed or routed. FIG. 1D depicts one non-limiting example of such a configuration, in which electrical wiring connected to a power source (not shown) passes through the side of floor base 400 and terminates in Electric connectors 402*a* and 402*b*. In some embodiments, the electrical wiring is configured to be connected to a source of electricity situated on or in a building structure. In some embodiments, the fan mount or base includes one or more contacts at which the electrical wiring terminates, and through which electricity can be delivered to one or more contacts/connectors of a fan connecting component described herein. Additional non-limiting examples of wiring configurations that can be associated with the fan mount and fan base are depicted in the referenced drawings and described herein below.

The fan mounts and bases described herein and depicted in the referenced figures can be made of any suitable material, including but in no way limited to plastic, PVC, rubber, metal, wood, composite materials, combinations thereof and the like.

Fan Connecting Section and Midsection Components

In various embodiments, the fan systems described herein include a fan device with a fan connecting component (FCC) situated at the end of a fan midsection (described above). It is contemplated that practically any fan known in the art with any type of air circulating device could be modified to terminate in a fan connecting section described herein, which could in turn connect to a fan mount and/or fan base described herein, thereby forming a modular fan system. Although practically any type of fan could be modified as described above, in some embodiments, the fan midsection includes one or more control mechanism configured to control the operation of the air circulating component through one or more switches, dials, buttons, and combinations thereof. In certain embodiments, the fan midsection includes a graphic user interface (GUI) or other display or indicator which provides information about the operation of the air circulating component, or one or more of its settings (e.g. speed, direction, duration of use, battery power, AC power, electrical connection status, fan base connection status, and combinations thereof). In some embodiments, the fan midsection houses a wireless transmitter configured to transmit the status of the function of any of the fan components (e.g. battery, air circulating components, etc.) to a central control device (e.g. dedicated remote control, PDA, multipurpose control tablet, smartphone, etc.). In some embodiments, the fan midsection includes one or more wireless receivers configured to receive wireless signals from one or more of the aforementioned control devices, and respond thereto by affecting the operation of one or more components of the fan system. Merely by way of example, a remote control may be configured to transmit a signal to the wireless receiver housed within the fan midsection (or elsewhere on the fan system), which causes a fan blade (in a bladed embodiment) to perform any of a variety of operations, including turning, stopping, speeding up, slowing down, changing directions, and the like. By way of example, FIG. 1A depicts a fan midsection that includes rechargeable battery 102, fan speed buttons 103*a* and 103*b*, and connecting section 111. It is important to note that the term "midsection" as used herein doesn't necessarily mean that section is located in the middle of a particular distance, rather it means that it is situated between two components or regions (e.g. between a connecting section and an air displacement component).

In some embodiments, the fan midsection can be configured with one or more telescoping components configured to allow for automatic (e.g. via wireless remote control) or manual adjustment of the fan midsection's overall length.

Air Circulating/Moving Component

The air circulating component of the fan device of the fan systems described herein may be of any variety known in the art, including bladeless or bladed types. When bladed, the "blades" or "paddles" can be of any shape known in the art. Merely by way of example, the blades can be of any type or shape described or depicted in U.S. patent application Ser. No. 09/008,042, which is incorporated herein by its reference in its entirety as though fully set forth. When bladeless, the fan can be configured to operate according to any bladeless system known in the art, including but in no way limited to the bladeless fan type described in U.S. Pat. No. 8,454,322, which is incorporated herein by reference in its entirety as though fully set forth. In yet other embodiments, the fan can be configured in a tower shape. Merely by way of example, the tower can be shaped according to any of the embodiments, or descriptions set forth in U.S. patent application Ser. No. 10/731,048, which is incorporated herein by reference in its entirety as though fully set forth.

Each of the air circulating components/sections described herein can be configured to oscillate by any means known in the art, and can be configured to be positioned at practically any desired angle, including by using an articulating neck or other mechanism known in the art. Certain non-limiting embodiments of the air circulating components are depicted in the drawings included herewith, and described in the examples set forth below.

Fan Power

As indicated above, the air circulating component(s) of the fan devices which are used in the fan systems of the invention could be any type of air circulating component(s) known in the art and associated with a bladeless fan, bladed fan, or tower fan. Regardless of the particular configuration, in each case the motion of the air circulating component(s) is driven by one or more motor, as is well known in the art. In some embodiments of the present invention, electricity is supplied to the motor(s) and other electrically-driven components of the fan device by a rechargeable battery located within the fan device. In some embodiments, the rechargeable battery is in turn connected through electrical wiring to electrical contacts located in the connecting section of the fan device. In some embodiments, these electrical contacts are configured to interface with the electrical contacts of a floor or ceiling mount and/or base (or base mounted on another type of building structure, as described herein), of a type described herein, and thereby receive electricity. In these embodiments, the electrical contacts of the floor or ceiling mount and/or base (or other base, as indicated above) are connected through one or more electrical wires to a source of electricity (e.g., a wall outlet of a building or main electrical source of a building). In this way the floor or ceiling base (or base suited to be mounted on another building structure as described herein) may serve as a charging station for the fan device, thereby forming one type of fan system. In some embodiments, when a rechargeable battery is integrated in the fan device, and charged in the manner indicated above, the fan device with the charged battery can be mounted in a floor or ceiling (or other building structure) base and/or mount that does not contain electrical wiring for power. In this way, the charged fan device (of any fan type described herein) can be attached to a mount and/or base on the floor, ceiling, or other building structure, whether or not the mount and/or base is connected to a power source. This provides a significant advantage over traditional fan devices, because by using this type of modular system, a fan can be moved from one room to the next, or from one location in a room to another, merely by attaching the fan (through its connecting section, as described herein) to any conveniently located mount and/or base.

In some embodiments, the fan device does not include a rechargeable battery, and instead the one or more motors are connected to wires that terminate in electrical contacts. These electrical contacts can then interact with electrical contacts located within a floor or ceiling (or other building structure) mount and/or base of a type described herein, which in turn is wired to receive electricity from a power source in the building (e.g. a wall outlet of a building or main electrical source of a building) in which it is located.

The powered floor bases described in various embodiments above (e.g. floor base 400 and floor base 900) are designed to charge various fan devices described herein, so that the charged fan devices can be subsequently mounted in a mounting station (e.g. a ceiling mount) that does not provide electricity.

Figure 15:
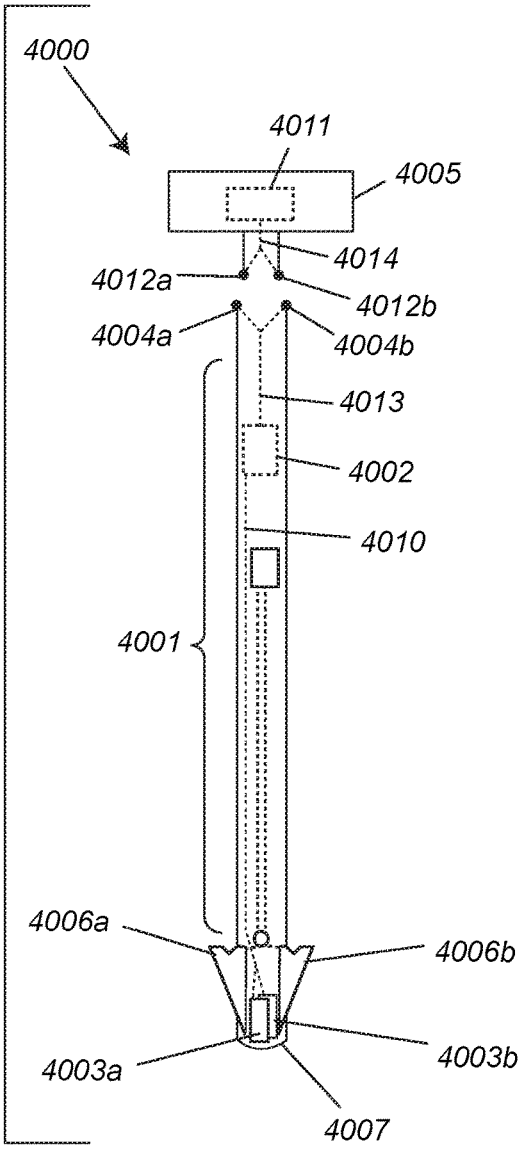
FIG. 15 depicts, in accordance with an embodiment of the invention, electrically powered device 4000, which includes charging post 4001, which houses vertically oriented rechargeable battery 4002.
Figure 16:
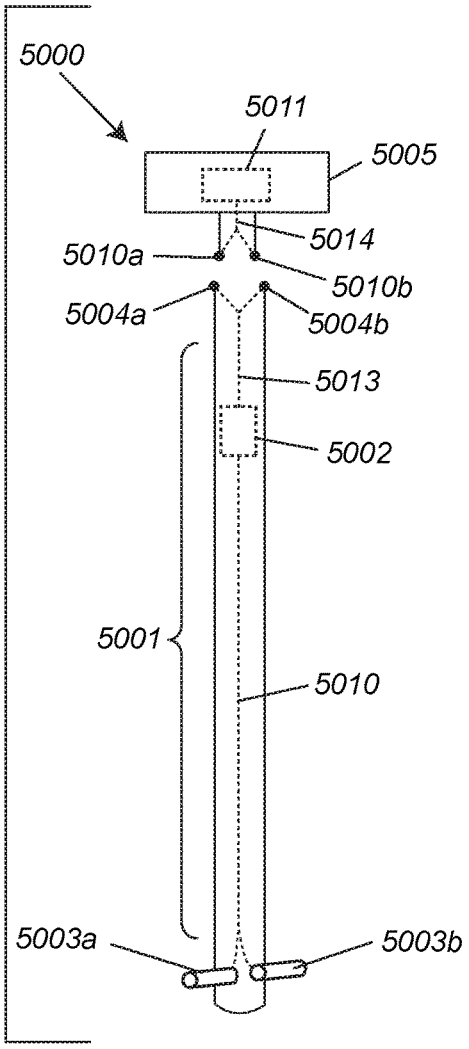
FIG. 16 depicts, in accordance with an embodiment of the invention, electrically powered device 5000, which includes charging post 5001, which houses vertically oriented battery 5002.

While the examples provided above all relate to various types of fans, the same general concept can be applied to charge a rechargeable battery located within any electrically powered device by docking/charging the device with an electrically wired floor mount, and then subsequently moving the electrically powered device to a separate mount that is not electrically wired (i.e. does not provide electricity). Therefore, in some embodiments the invention teaches a system that includes (1) an electrically powered device with electrically powered elements (e.g., motor, lights, etc.), (2) one or more rechargeable battery housed in a charging post of the device and connected to the electrically powered elements of the electrically powered device through electrical wiring (either directly, or indirectly through one or more electrical contacts, including complimentary pairs of electrical contacts (e.g., as shown in FIGS. 15 and 16)), and (3) a connecting section described above that is configured to mate with (e.g. via retracting wedges described above, or via post-shaped contacts described above) a powered floor base (e.g., floor base 400 or floor base 900) and a ceiling mount (e.g., ceiling mount 200 or ceiling mount 800) as described above. Although the batteries of each of the embodiments depicted in FIGS. 13-16 of the ensuing "Examples" section are all single, vertically oriented batteries, multiple and/or differently shaped batteries could also be used without departing from the spirit of the invention.

Any of a number of types of batteries, including types of rechargeable batteries, could be used to power the inventive devices and systems described herein. Merely by way of non-limiting examples, specific battery types that could be used include a Nickel Cadmium (NiCd) battery, a Nickel-Metal Hydride (NiMH) battery, a Lead Acid battery, a Lithium Ion battery, or a Lithium polymer battery.

Importantly, by modifying the configuration of the electrical wiring described herein by various ways known in the art, the devices described herein that contain one or more rechargeable batteries can be operated while the one or more rechargeable batteries are being charged (e.g., by routing a portion of the electrical current from the powered base around the battery to one or more electrically driven components, or by supplying electricity from the battery to one or more electrically driven components while the battery is being charged).

The following examples are offered for illustrative purposes only, and are not intended to limit the scope of the present invention in any way.

EXAMPLES

Example 1

Detachable Bladeless Fan Systems

Although not depicted for the sake of making other components clear, in all of the examples of bladeless fan devices and systems described herein, the "bladeless" fans actually have blades driven by an electric motor concealed in the base of the unit. A motor-driven impeller fan sucks air through vent slits (e.g. vents/slits 112 in FIG. 1A) in the base and pushes it into the hollow hoop (e.g. hoop 101 in FIG. 1A). The back of the hoop has a thin slot running completely around the hoop and facing forward. Air is blown through the thin slot toward a Coanda adhesion airfoil that channels the air into a straight forward-moving annular jet stream. The bladeless fan dramatically increases air circulation. As air is forced from the relatively fat hoop through the thin slot, it speeds up and its pressure drops. The high-velocity, low-pressure annular air stream sucks room air in from behind and alongside the hoop. This has the effect of multiplying the circulation of air, as the bladeless fans described herein put out about 15 units of air for every unit of air drawn into the fan's base.

FIG. 1A depicts mechanical oscillating bladeless fan device 100 which can be used to move air through a room or other area. Bladeless fan device 100 includes a circular section 101 for movement of air (in a typical manner for bladeless fans described above). As shown in FIG. 1A, bladeless fan device 100, is placed over ceiling mount 200, which is in turn connected to ceiling base 300, which is in turn connected to the ceiling of a building (not shown). Bladeless fan device 100 includes circular section/hollow hoop 101 configured to move air. Bladeless fan device 100 further includes: rechargeable battery 102, fan speed buttons 103*a* (increases amount of air displaced when depressed) and 103*b* (decreases amount of air displaced when depressed), power indicator light 104, AC power and battery charge status indicator light 105, retractable and spring loaded wedges 107*a* and 107*b*, wedge retracting lever 106, wedge connecting line 114 (mechanically connecting wedge retracting lever 106 to retracting wedges 107*a* and 107*b*), electrical connectors/contacts 108*a* and 108*b*, mounting cylinder 109, electrical wire 110, air vent slits 112, connecting section 111, and wedge housing cylinder 115. Bladeless fan device 100 operates through direct current (DC) supplied by rechargeable battery 102 when mounted to the ceiling through ceiling mount 200, and is charged by alternating current (AC) from a wall source when mounted on the floor through floor base 400 (FIG. 1D). Bladeless fan device 100 can be connected to ceiling mount 200 by placing connecting section 111 over ceiling mount 200. When connecting section 111 is placed over ceiling mount 200, wedges 107*a* and 107*b* retract as they move through hole 205 in the narrow section 203 of ceiling mount 200 (which applies pressure to the edges of wedges 107*a* and 107*b* as they pass through) and then spread out (form a wedge shape) again when located completely inside narrow section 203 of ceiling mount 202. As the edges of spread out wedges 107*a* and 107*b* that are facing wedge retracting lever 106 cannot fit through hole 205, bladeless fan device 100 becomes connected to ceiling mount 200. Ceiling mount 200 is connected to ceiling base 300 by inserting screws 301 through holes 302. More specifically, inserted screws 301 apply pressure on base 204 of ceiling mount 200. Ceiling mount 200 is mounted to the ceiling by placing securing screws or other fasteners (not shown) through holes 303. With the foregoing components in mind, ceiling base 300 can be attached to a ceiling, as described above. Ceiling mount 200 can then be connected to ceiling base 300, as described above. Finally, bladeless fan device 100 can be attached to ceiling mount 200, as described above. In operation, rechargeable battery 102 is electrically connected to a motor that drives the function of the air moving components which displace air in the room in which bladeless fan device 100 has been mounted according to the preceding steps. Rechargeable battery 102 also supplies power to all other electrically-powered components (i.e. indicator lights, etc.) of bladeless fan device 100. Rechargeable battery 102 is also connected to electrical wiring that terminates in electrical contacts 108A and 108B. As shown in FIG. 1C, bladeless fan device 100 can be removed from ceiling mount 200 by sliding wedge retracting lever 106 in the direction of the arrow situated just below wedge retracting lever 106. As lever 106 slides in that direction, tension from wedge connecting line 114 retracts wedges 107*a* and 107*b* into slits in wedge housing cylinder 115, thereby allowing bladeless fan device 100 to separate from ceiling mount 200. After bladeless fan device 100 is separated from ceiling mount 200 (or any time before bladeless fan device 100 is engaged in ceiling mount 200), bladeless fan device 100 can be mated with floor base 400. As can be seen in FIG. 1D, floor base 400 includes the same mating features as ceiling mount 200, and therefore cylinder 109 of connecting section 111 can be placed over narrow section 403 of floor base 400, thereby causing retracting wedges 107*a* and 107*b* to initially retract into wedge housing cylinder 115 as they pass through hole 405, and then spread out (form a wedge shape) again so that the edges facing wedge retractor lever 106 are blocked by rim 402. Electrical contacts 108*a* and 108*b* are then in a position abutting electrical contacts 402*a* and 402*b*, respectively. Electricity flows through electrical wiring 401 and then through electrical wiring 110 connected to rechargeable battery 102. Thus, rechargeable battery 102 can be charged when mated with floor base 400.

When bladeless fan device 100 is connected to ceiling mount 200 (which is in turn connected to ceiling base 300, as shown in FIG. 1 and described above), it relies on direct current from rechargeable battery 102 for power, as ceiling mount 200 and ceiling base 300 are not associated with a source of electricity. Because no electrical wires are associated with this type of "powerless base," it can be mounted on practically any building structure, as described above. In contrast, as indicated above, floor base 400 is configured with electrical wiring connected to a source of electricity. This type of "powered base" is configured to charge rechargeable battery 102.

Figures 2A, 2B, 2C, 2D:
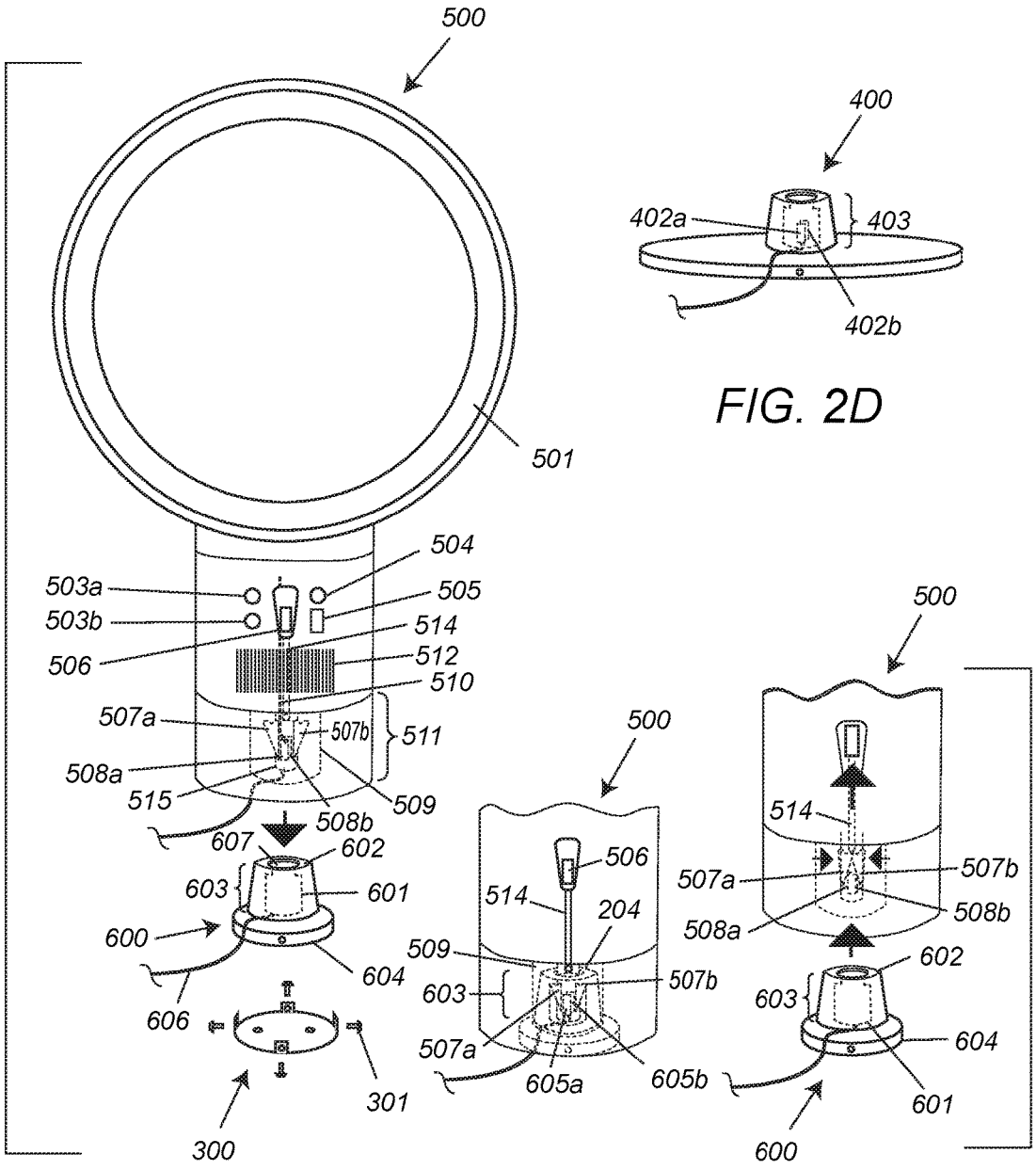
FIG. 2A depicts, in accordance with an embodiment of the invention, bladeless fan device 500, which is placed over ceiling mount 600, which is in turn connected to ceiling base 300. Bladeless fan device 500 operates through AC power whether mounted to the ceiling through ceiling mount 600 or the floor through floor base 400 (FIG. 2D).
FIG. 2B depicts, in accordance with an embodiment of the invention, bladeless fan device 500 connected to ceiling mount 600.
FIG. 2C depicts, in accordance with an embodiment of the invention, bladeless fan device 500 as it is being removed from ceiling mount 600 in the manner described above for FIG. 1C.
FIG. 2D depicts, in accordance with an embodiment of the invention, floor base 400 (connected to a source of electricity (not shown)) which is designed to mate with bladeless fan device 500 and supply electricity to the electrically-powered components (i.e., motor, indicator lights, etc.) of bladeless fan device 500 when floor base 400 is connected to bladeless fan device 500.

FIG. 2A depicts bladeless fan device 500, which is placed over ceiling mount 600, which is in turn connected to ceiling base 300, which is in turn connected to the ceiling of a building (not shown). Bladeless fan device 500 includes air moving component 501 for configured to move air in the manner of a typical bladeless fan device (as described above). Bladeless fan device 500 further includes: fan speed buttons 503*a* (increases amount of air displaced when depressed) and 503*b* (decreases amount of air displaced when depressed), wireless remote sensor/receiver 504, AC power and battery charge status indicator light 505, retractable and spring loaded wedges 507*a* and 507*b*, wedge retracting lever 506, wedge connecting line 514 (which mechanically connects wedge retracting lever 506 to retracting wedges 507*a* and 507*b*), Electric connectors/contacts 508*a* and 508*b*, mounting cylinder 509, electrical wiring 510, vents 512, connecting section 511, and wedge housing cylinder 515. Bladeless fan device 500 operates through alternating current (AC) supplied by electrically wired ceiling mount 600 FIG. 2B, or electrically wired floor base 400 (FIG. 2D). A system formed from the components shown in FIG. 2A, which includes bladeless fan device 500, ceiling mount 600, and ceiling base 300, has a few different features from the analogous system depicted in FIG. 1A. First, fan device 500 does not include a rechargeable battery. Second, ceiling mount 600 includes electrical wiring 606 that terminates in electrical contacts 605*a* and 605*b*. Electrical wiring 606 is connected to a source of electricity (not shown), and therefore ceiling mount 600 and ceiling base 300 form a powered base configuration described above electrical contacts 508*a* and 508*b* are positioned to mate with AC contacts 605*a* and 605*b* when cylinder 509 is positioned over narrow section 603 of ceiling mount 600 (as shown in FIG. 2B), such that retracting wedges 507*a* and 507*b* are engaged in ceiling mount 600 in the same manner as retracting wedges 107*a* and 107*b* in ceiling mount 200 of FIG. 1. As shown in FIG. 2C, bladeless fan device 500 can be separated from ceiling mount 600 in the same manner bladeless fan device 100 is separated from ceiling mount 200 (described above). Likewise, bladeless fan device 500 can be connected to floor base 400 in the same manner bladeless fan device 100 is connected to floor base 400 (described above). Ultimately, as bladeless fan device 500 does not have a rechargeable battery, it relies on AC power for operation, whether from ceiling mount 600, floor base 400, or another mount/base with a powered base configuration. Nevertheless, bladeless fan device 500 can be used as part of a modular fan system in which one or more powered bases are positioned in different locations, and bladeless fan device 500 can be removably connected to any of the powered bases, as desired.

Figure 3A:
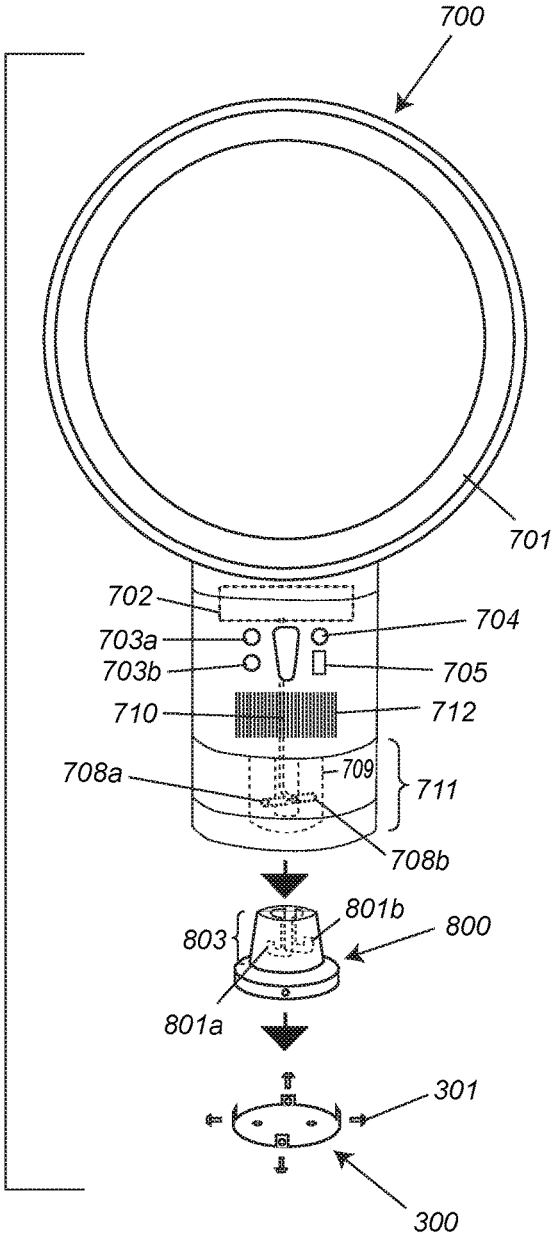
FIG. 3A depicts, in accordance with an embodiment of the invention, bladeless fan device 700, which is placed over ceiling mount 800, which is in turn connected to ceiling base 300. Bladeless fan device 700 operates through direct current (DC) supplied by rechargeable battery 702 when mounted to the ceiling through ceiling mount 800, and is charged by alternating current (AC) from a wall source when mounted on the floor through floor base 900 (FIG. 3D).
Figure 3D:
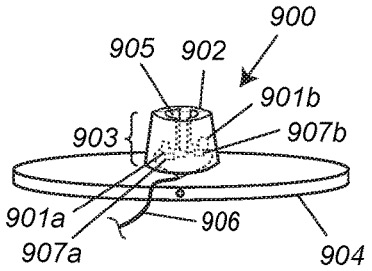
FIG. 3D depicts, in accordance with an embodiment of the invention, floor base 900 (connected to a source of electricity (not shown)) which is designed to mate with and charge the rechargeable battery 702 of bladeless fan device 700 when floor base 900 is mated with bladeless fan device 700.
Figure 3C:
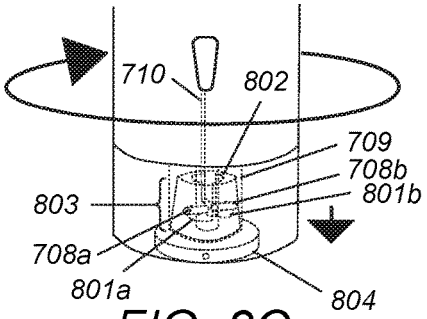
FIG. 3C depicts, in accordance with an embodiment of the invention, bladeless fan device 700 as it is being first inserted over (shown by straight arrow) ceiling mount 800 and then twisted (in the direction of the circling arrow) once posts 708*a* and 708*b* are touching the portion of channels 801*a* and 801*b* closest to the broadest end of ceiling mount 800.
Figure 3B:
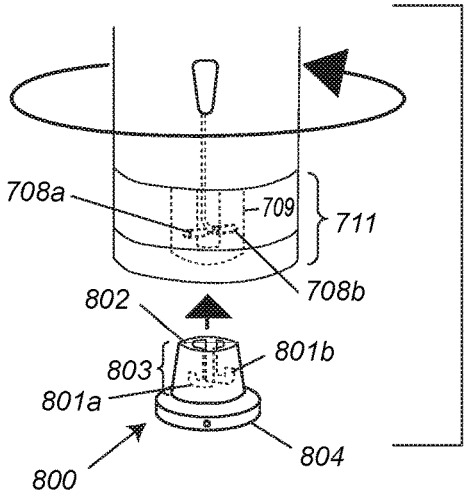
FIG. 3B depicts, in accordance with an embodiment of the invention, bladeless fan device 700 as it is being first twisted (in the direction of circling arrow) and then removed (shown by straight arrow) from ceiling mount 800.

Bladeless fan device 700 (FIG. 3A) includes: air moving component 701 (the same component as 501 described above), rechargeable battery 702, fan speed buttons 703*a* (increases amount of air displaced when depressed) and 703*b* (decreases amount of air displaced when depressed), wireless remote sensor/receiver 704, AC power and battery charge status indicator light 705, electrical wiring 710 (connecting from post-shaped electrical contacts 708*a* and 708*b* to rechargeable battery 702, vents 712, mounting cylinder 709, and connecting section 711. Ceiling mount 800 depicted in FIG. 3A has channels 801*a* and 801*b* designed to mate with post-shaped electrical contacts 708*a* and 708*b*. Ceiling mount 800 is designed to connect to ceiling base 300 in the same manner ceiling mount 200 connects with ceiling base 300 (as described above). As shown in FIG. 3A, mounting cylinder 709 is placed over narrow section 803 of ceiling mount 800, such that post-shaped electrical contacts 708*a* and 708*b* enter channels 801*a* and 801*b*, respectively. Next, bladeless fan device 700 is rotated clockwise so that post-shaped electrical contacts 708*a* and 708*b* enter the portion of channels 801*a* and 801*b* that curve toward rim 802 of ceiling mount 800. Thus, when ceiling mount 800 is connected to a ceiling through ceiling base 300, and mounting cylinder 709 is placed over narrow section 803 of ceiling mount 800 and twisted clockwise (as shown in FIG. 3C), post-shaped electrical contacts 708*a* and 708*b* become lodged in the portion of channels 801*a* and 801*b* that curve toward rim 802 of ceiling mount 800, and thereby secure bladeless fan device 700 to ceiling mount 800. In order to remove bladeless fan device 700 from ceiling mount 800 (which is mounted to the ceiling through ceiling base 300), bladeless fan device 700 is pushed slightly toward ceiling mount 800 and then rotated until post-shaped electrical contacts 708*a* and 708*b* enter the elongated sections of channels 801*a* and 801*b*, at which point bladeless fan device 700 can be easily separated from ceiling mount 800 (as shown in FIG. 3B). The electrically-powered components (motor, indicator lights, etc.) of bladeless fan device 700 are powered by rechargeable battery 702 when bladeless fan device 700 is mated with ceiling mount 800 (which is in turn mounted to ceiling base 300). Bladeless fan device 700 may also be mated with floor base 900. Floor base 900 includes narrow section 903, rim 902, channels 901*a* and 901*b*, electrical wiring 906 (which is connected to a source of electricity (not shown)), and broad base 904. Bladeless fan device 700 can be mated with floor base 900 by placing mounting cylinder 709 over narrow section 903 of floor base 900, and then rotating bladeless fan device 700 until post-shaped electrical contacts 708*a* and 708*b* abut electrical contacts 907*a* and 907*b* in channels 901*a* and 901*b*, respectively. Electricity flows through electrical wiring 906 and eventually into rechargeable battery 702.

Figure 4A:
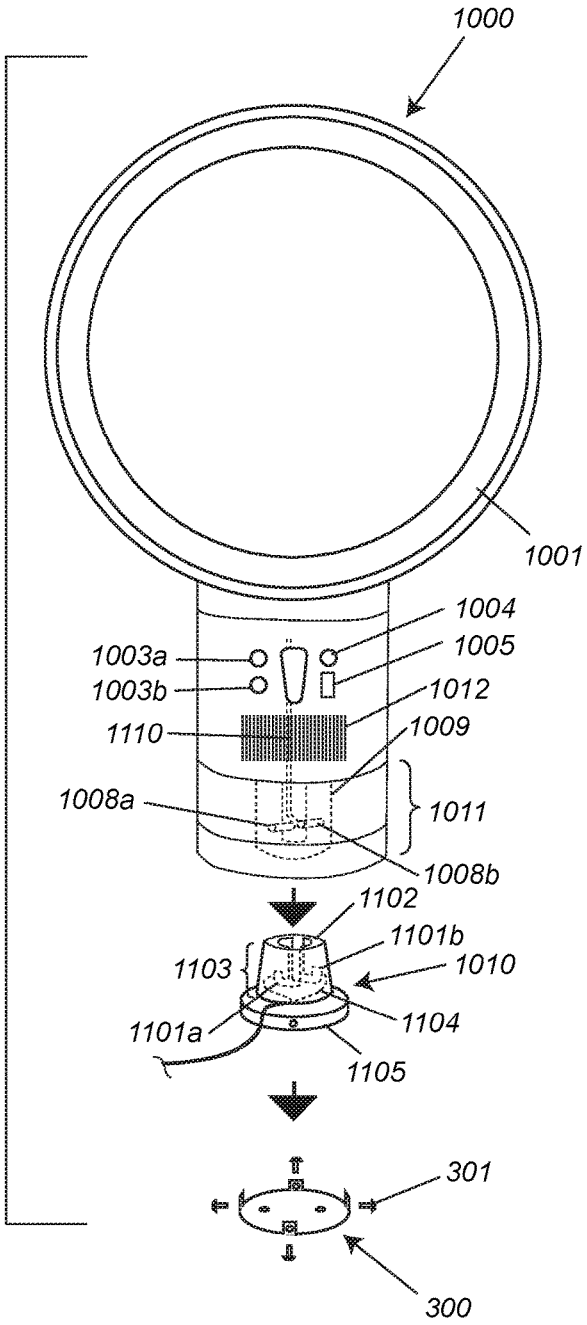
FIG. 4A depicts, in accordance with an embodiment of the invention, bladeless fan device 1000, which is placed over ceiling mount 1100, which is in turn connected to ceiling base 300. Bladeless fan device 1000 operates through AC power whether mounted to the ceiling through ceiling mount 1100 or the floor through floor base 900 (FIG. 4D).
Figure 4D:
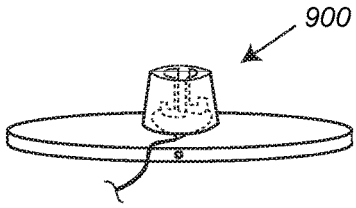
FIG. 4D depicts, in accordance with an embodiment of the invention, floor base 900 (connected to a source of electricity (not shown)) which is designed to mate with bladeless fan device 1000 and provide electricity to the electrically-powered components (i.e., motor, indicator lights, etc.) of bladeless fan device 1000 when floor base 900 is connected to bladeless fan device 1000.
Figure 4C:
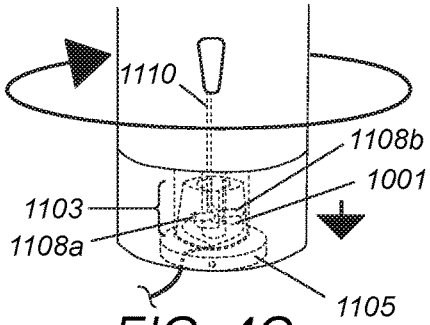
FIG. 4C depicts, in accordance with an embodiment of the invention, bladeless fan device 1000 as it is being inserted over ceiling mount 1100 in the manner described above for FIG. 3C.
Figure 4B:
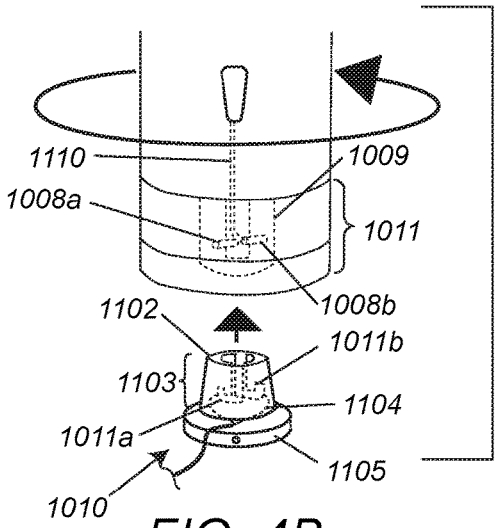
FIG. 4B depicts, in accordance with an embodiment of the invention, bladeless fan device 1000 as it is being removed from ceiling mount 1100 in the manner described above for FIG. 3B.

Bladeless fan device 1000 (FIG. 4A) includes: air moving component 1001 (which functions the same as air moving component 701), fan speed buttons 1003*a* (increases amount of air displaced when depressed) and 1003*b* (decreases amount of air displaced when depressed), wireless remote sensor/receiver 1004, AC power and battery charge status indicator light 1005, electrical wiring 1010 (connecting to post-shaped electrical contacts 1008*a* and 1008*b* as well as the motor (not shown) of bladeless fan device 1000 and other electrically-powered components (e.g., battery charge status indicator light 705, wireless remote sensor/receiver, etc.)), vent 1012, mounting cylinder 1009, and connecting section 1011. Ceiling mount 1100 depicted in FIG. 4A has channels 1101*a* and 1101*b* designed to mate with post-shaped electrical contacts 1008*a* and 1008*b*. Channels 1101*a* and 1101*b* terminate in electrical contacts 1108*a* and 1108*b*. Ceiling mount 1100 further includes narrow section 1103, rim 1102, and electrical wiring 1104. Ceiling mount 1100 is designed to connect to ceiling base 300 in the same manner ceiling mount 200 connects with ceiling base 300 (as described above). As shown in FIG. 4A, mounting cylinder 1009 is placed over narrow section 1103 of ceiling mount 1100, such that post-shaped electrical contacts 1008*a* and 1008*b* enter channels 1101*a* and 1101*b*, respectively. Next, bladeless fan device 1000 is rotated clockwise so that post-shaped electrical contacts 1008*a* and 1008*b* enter the portion of channels 1101*a* and 1101*b* that curve toward rim 1102 of ceiling mount 1100. Thus, when ceiling mount 1100 is connected to a ceiling through ceiling base 300, and mounting cylinder 1009 is placed over narrow section 1103 of ceiling mount 1100 and twisted clockwise (as shown in FIG. 4C), post-shaped electrical contacts 1008*a* and 1008*b* become lodged in the portion of channels 1101*a* and 1101*b* that curve toward rim 1102 of ceiling mount 1100, and thereby secure bladeless fan device 1000 to ceiling mount 1100. In order to remove bladeless fan device 1000 from ceiling mount 1100 (which is mounted to the ceiling through ceiling base 300), bladeless fan device 1000 is pushed toward ceiling mount 1100 and then rotated until post-shaped electrical contacts 1008*a* and 1008*b* enter the elongated sections of channels 1101*a* and 1101*b*, at which point bladeless fan device 1000 can be easily separated from ceiling mount 1100 (as shown in FIG. 4B). The electrically-powered components (motor, indicator lights, etc.) of bladeless fan device 1100 are powered by electricity supplied by electrical wiring 1104, when bladeless fan device 1100 is mated with ceiling mount 1100 (which is in turn mounted to ceiling base 300). Bladeless fan device 1000 may also be mated with floor base 900 (see FIGS. 3D and 4D) in the same manner that bladeless fan device 700 is mounted with floor base 900 (described above). Because it does not have a rechargeable battery, bladeless fan device 1000 is powered by electricity delivered by ceiling mount 1100 or floor base 900, as described above.

Example 2

Detachable Fan Tower Systems

Although there are many types of fans shaped like towers (referred to herein as "fan towers" or "tower fans"), the fan tower systems and devices of the present application oscillate like most ordinary fans, but with a wider area of air circulation coverage and distribution (due to the length of the vent running the full height of the fan). All tower fans described herein oscillate on a base stand and distribute air circulation at a 90-degree angle. In some embodiments of the present invention, a timer is included in the control panel, which can be set to operate for up to several hours before shutting itself down (power off). Some embodiments of the present invention also include ionizers. In those embodiments, an ionizer button is located on the control panel for activating air purification (this can also be accomplished wirelessly with a wireless sensor). Certain embodiments of the present invention also include a permanent or removable air filter, which helps prevent the spread of pollen and dust. In the embodiments described herein, although not depicted, a cylindrical container within the fan tower houses the fan tower's impeller. The impeller blades move air through the cylindrical column and then out of the vents of the tower fan. Unlike an ordinary fan's propeller blades (which move air in a horizontal direction), the tower fan's impeller blades move air up and down the column. This configuration and function of impeller blades is well known in the art. The cylindrical column has openings and closings that allow or block air from escaping the cylindrical container. The impeller is nearly as tall as the fan unit (up to 30 inches on some models). In the embodiments described herein, an air blower houses the air impeller that moves air through a vertical shaft. An inlet for the air is located in the side of the tower fan casing (not shown in the figures). The air intake travels to the air guide. From the air guide, the air stream moves out the exit vent. Air is distributed from the air blower assembly to the surrounding environment. The air current moves in a vertical wave out from the tower fan, distributing air to the room in which the fan tower is placed.

Figures 5A, 5B, 5C, 5D:
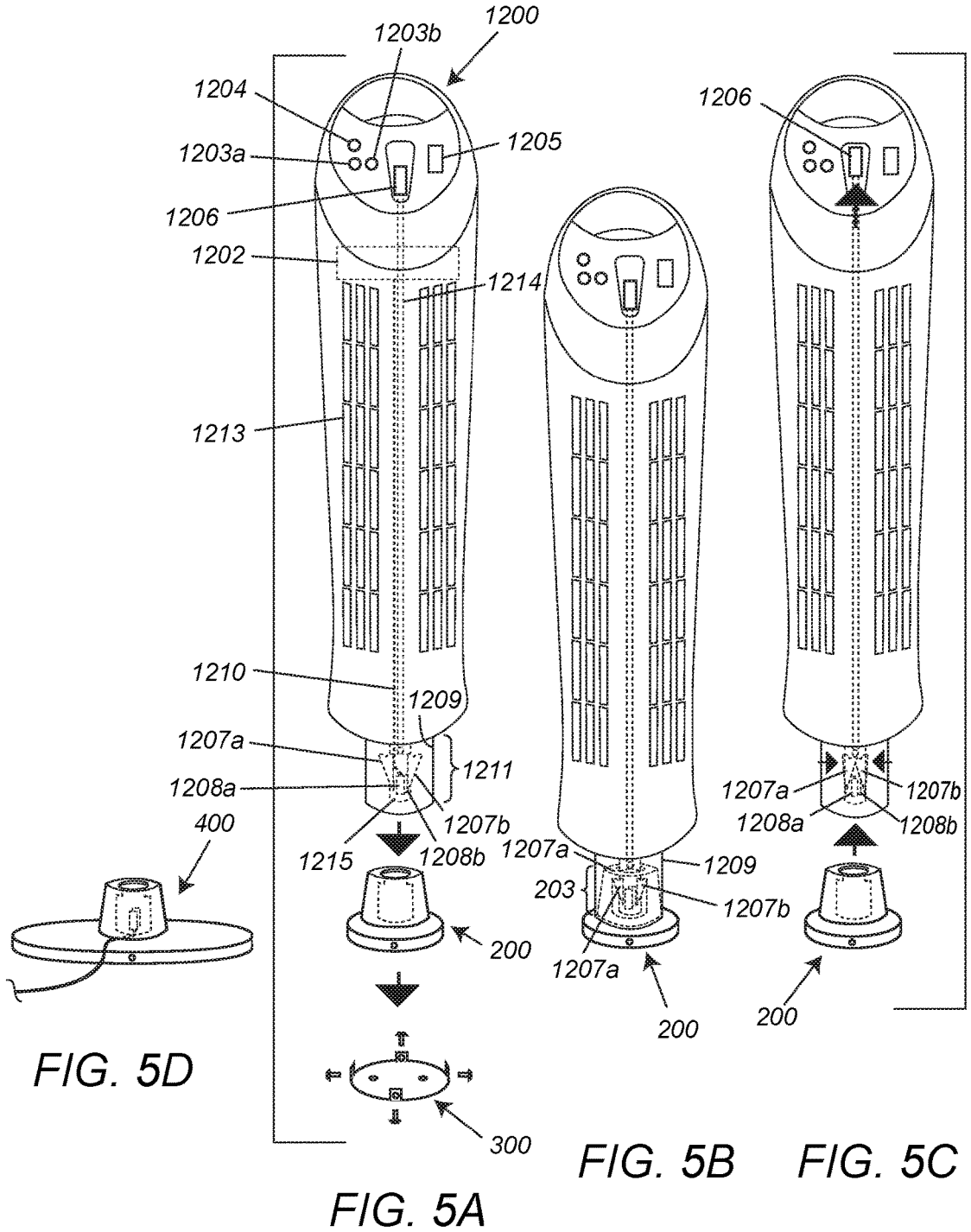
FIG. 5A depicts, in accordance with an embodiment of the invention, fan tower device 1200, which is placed over ceiling mount 200, which is in turn connected to ceiling base 300. Fan tower device 1200 operates through direct current (DC) supplied by rechargeable battery 1202 when mounted to the ceiling through ceiling mount 200, and is charged with alternating current (AC) from a wall source when mounted on the floor through floor base 400 (FIG. 5D).
FIG. 5B depicts, in accordance with an embodiment of the invention, fan tower device 1200 connected to ceiling mount 200.
FIG. 5C depicts, in accordance with an embodiment of the invention, fan tower device 1200 as it is being removed from ceiling mount 200. Fan tower device 1200 is removed from ceiling mount 200 by moving lever 1206 in the direction indicated by the arrow under lever 1206, which retracts wedges 1207*a* and 1207*b* into slits of cylinder 1215.
FIG. 5D depicts, in accordance with an embodiment of the invention, floor base 400 (connected to a source of electricity (not shown)) which is designed to mate with fan tower device 1200 and charge rechargeable battery 1202 of fan tower device 1200.

FIG. 5A depicts fan tower device 1200, which is placed over ceiling mount 200, which is in turn connected to ceiling base 300, which is in turn connected to the ceiling of a building (not shown). Fan tower device 1200 moves air in the manner of traditional fan tower devices (as described above). Fan tower device 1200 further includes: rechargeable battery 1202, fan speed buttons 1203*a* (increases amount of air displaced when depressed) and 1203*b* (decreases amount of air displaced when depressed), power indicator light 1204, battery charge status indicator light

1205, retractable and spring loaded wedges 1207*a* and 1207*b*, wedge retracting lever 1206, wedge connecting line 1214 (mechanically connecting wedge retracting lever 1206 to retracting wedges 1207*a* and 1207*b*), electrical connectors/contacts 1208*a* and 1208*b*, mounting cylinder 1209, electrical wiring 1210, air vents 1213, connecting section 1211, and wedge housing cylinder 1215. Fan tower device 1200 operates through direct current (DC) supplied by rechargeable battery 1202 when mounted to the ceiling through ceiling mount 200, and is charged by alternating current (AC) from a wall source when mounted on the floor through floor base 400 (FIG. 1D). Fan tower device 1200 can be mated with ceiling mount 200 by placing connecting section 1211 over ceiling mount 200 (as shown in FIG. 5B), in the same manner as bladeless fan device 100 is mated with ceiling mount 200 (as described above). Ceiling mount 200 is connected to ceiling base 300 as described herein above. In operation, battery 1202 is electrically connected to a motor that drives the air displacing function of fan tower device 1200 and thereby displaces air in the room in which fan tower device 1200 has been mounted according to the preceding steps. Rechargeable battery 1202 also supplies power to all other electrically-powered components (i.e. indicator lights, etc.) of fan tower device 1200. Rechargeable battery 1202 is also connected to electrical wiring that terminates in electrical contacts 1208A and 1208B. As shown in FIG. 5C, fan tower device 1200 can be removed from ceiling mount 200 by sliding wedge retracting lever 1206 in the direction indicated by the arrow just below retracting lever 1206. As lever 1206 slides in the direction indicated by said arrow, tension from wedge connecting line 1214 retracts retracting wedges 1207*a* and 1207*b* into slits in wedge housing cylinder 1215, thereby allowing fan tower device 1200 to separate from ceiling mount 200. After fan tower device 1200 is separated from ceiling mount 200 (or before the two components are mated), fan tower device 1200 can be mated with floor base 400 in the same manner bladeless fan device 100 is mounted with floor base 400. Electricity flows through the electrical wiring of floor base 400 and then through electrical wiring 1210 connected to rechargeable battery 1202. Thus, rechargeable battery 1202 can be charged when fan tower device 1200 is mated with floor base 400.

When fan tower device 1200 is connected to ceiling mount 200 (which is in turn connected to ceiling base 300, as shown in FIG. 5A and described above), it relies on direct current from rechargeable battery 1202 for power, as ceiling mount 200 and ceiling base 300 are not associated with a power source. Because no electrical wires are associated with this type of powerless base, it can be mounted on practically any building structure, as described above. In contrast, as indicated above, floor base 400 is configured with electrical wiring connected to a source of electricity.

Figures 6A, 6B, 6C, 6D:
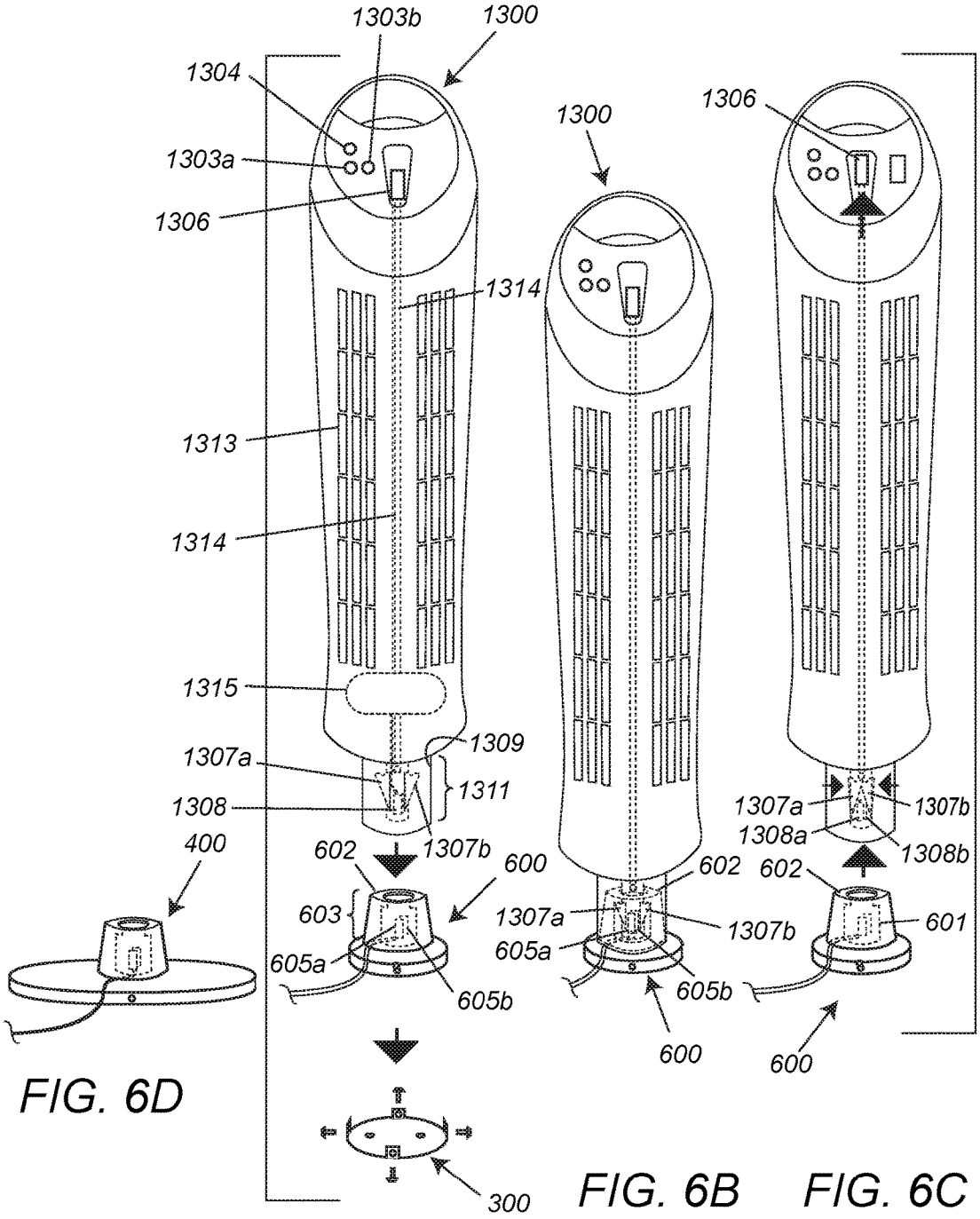
FIG. 6A depicts, in accordance with an embodiment of the invention, fan tower device 1300, which is placed over ceiling mount 600, which is in turn connected to ceiling base 300. Fan tower system 1300 operates through AC power whether mounted to the ceiling through ceiling mount 600 or the floor through floor base 400 (FIG. 6D).
FIG. 6B depicts, in accordance with an embodiment of the invention, fan tower device 1300 connected to ceiling mount 600.
FIG. 6C depicts, in accordance with an embodiment of the invention, fan tower device 1300 as it is being removed from ceiling mount 600 in the manner described above for FIG. 5C.
FIG. 6D depicts, in accordance with an embodiment of the invention, floor base 400 (connected to a source of electricity (not shown)) which is designed to mate with fan tower device 1300 and provide electricity to the electrically-powered components (i.e., motor, indicator lights, etc.) of fan tower device 1300 when fan tower device 1300 is connected to floor base 400.

FIG. 6A depicts fan tower device 1300, which is placed over ceiling mount 600, which is in turn connected to ceiling base 300, which is in turn connected to the ceiling of a building (not shown). Fan tower device 1300 moves air in the same manner as the fan tower devices described above. Fan tower device 1300 further includes: fan speed buttons 1303*a* (increases amount of air displaced when depressed) and 1303*b* (decreases amount of air displaced when depressed), AC power status indicator light 1304, retractable and spring loaded wedges 1307*a* and 1307*b*, wedge retracting lever 1306, wedge connecting line 1314 (which mechanically connects wedge retracting lever 1306 to retracting wedges 1307*a* and 1307*b*), electrical connectors/contacts 1308*a* and 1308*b*, mounting cylinder 1309, electrical wiring 1310, air vents 1313, connecting section 1311, and fan motor 1315. Fan tower device 1300 operates through alternating current (AC) supplied by electrically wired ceiling mount 600 (FIG. 6B), or electrically wired floor base 400 (FIG. 6D). As shown in FIG. 6C, fan tower device 1300 can be separated from ceiling mount 600 in the same manner bladeless fan device 100 is separated from ceiling mount 200 (described above). Likewise, fan tower device 1300 can be connected to floor base 400 in the same manner bladeless fan device 100 is connected to floor base 400 (described above). Ultimately, as fan tower device 1300 does not have a rechargeable battery, it relies on AC power for operation, whether from ceiling mount 600, floor base 400, or another mount/base with a powered base configuration. Nevertheless, fan tower device 1300 can be used as part of a modular fan system in which one or more powered bases are positioned in different locations, and fan tower device 1300 can be removably connected to any of the powered bases, as desired.

Figures 7A, 7B, 7C, 7D:
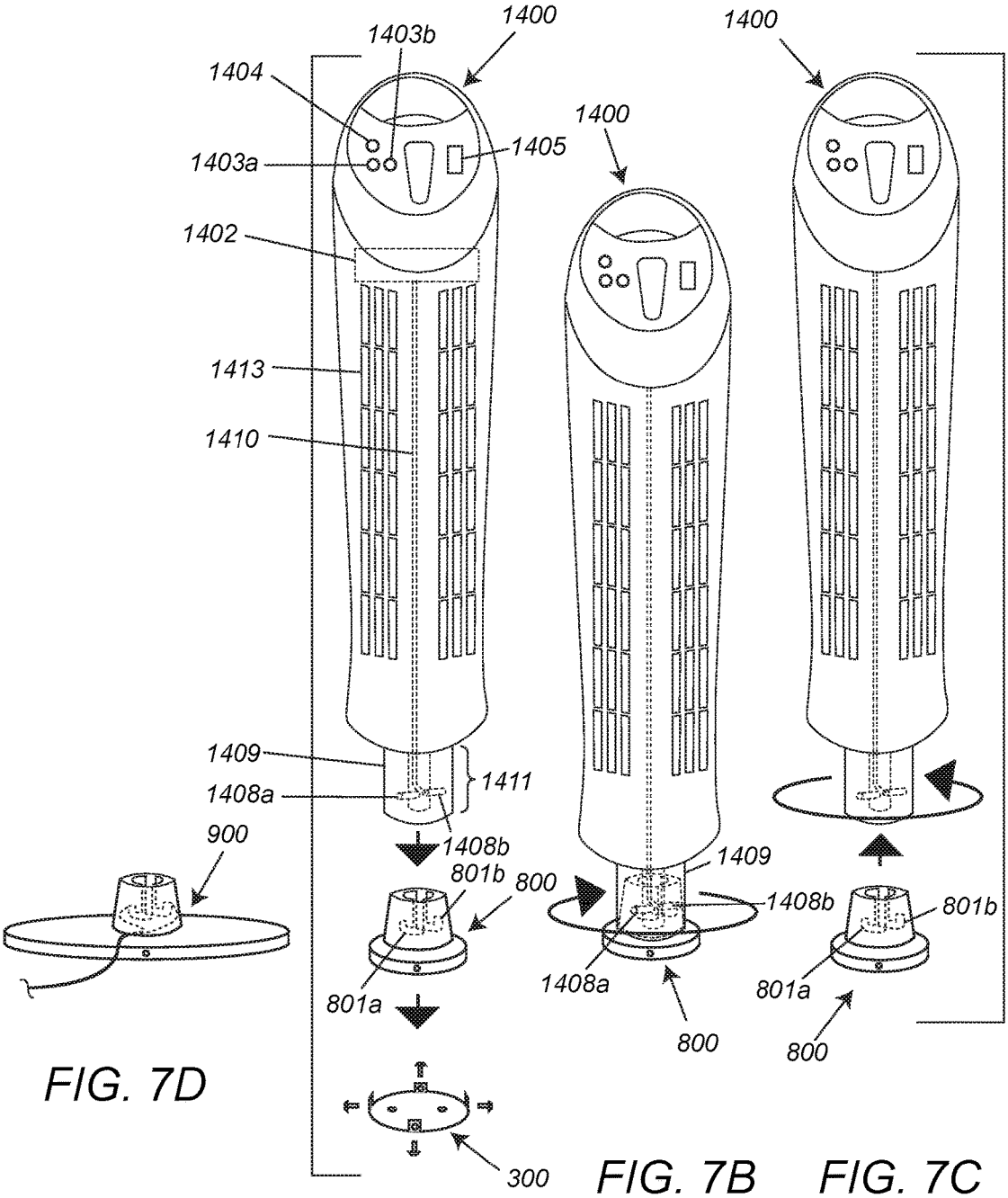
FIG. 7A depicts, in accordance with an embodiment of the invention, fan tower device 1400, which is placed over ceiling mount 800, which is in turn connected to ceiling base 300. Fan tower device 1400 operates through direct current (DC) supplied by rechargeable battery 1402 when mounted to the ceiling through ceiling mount 800, and is charged by alternating current (AC) from a wall source when mounted on the floor through floor base 900 (FIG. 7D).
FIG. 7B depicts, in accordance with an embodiment of the invention, fan tower device 1400 as it is being twisted to mate with ceiling mount 800 in the manner described above for FIG. 3C.
FIG. 7C depicts, in accordance with an embodiment of the invention, fan tower device 1400 being removed from ceiling mount 800 in the manner described above for FIG. 3B.
FIG. 7D depicts, in accordance with an embodiment of the invention, floor base 900 (connected to a source of electricity (not shown)) which is designed to mate with fan tower device 1400 and charge the rechargeable battery 1402 of fan tower device 1400.

Fan tower device 1400 (FIG. 7A) moves air in the same manner as the fan tower devices described above. Fan tower device 1400 includes rechargeable battery 1402, fan speed buttons 1403*a* (increases amount of air displaced when depressed) and 1403*b* (decreases amount of air displaced when depressed), wireless remote sensor/receiver 1404, AC power and battery charge status indicator light 1405, electrical wiring 1410 (connecting from post-shaped electrical contacts 1408*a* and 1408*b* to rechargeable battery 702). Ceiling mount 800 depicted in FIG. 7A has channels 801*a* and 801*b* designed to mate with post-shaped electrical contacts 1408*a* and 1408*b*. Ceiling mount 800 is designed to connect to ceiling base 300 in the same manner ceiling mount 200 connects with ceiling base 300 (as described above). As shown in FIG. 7A, mounting cylinder 1409 is placed over narrow section 803 of ceiling mount 800, such that post-shaped electrical contacts 1408*a* and 1408*b* enter channels 801*a* and 801*b*, respectively. Next, fan tower device 1400 is rotated clockwise so that post-shaped electrical contacts 1408*a* and 1408*b* enter the portion of channels 801*a* and 801*b* that curve toward rim 802 of ceiling mount 800. Thus, when ceiling mount 800 is connected to a ceiling through ceiling base 300, and mounting cylinder 1409 is placed over narrow section 803 of ceiling mount 800 and twisted clockwise (as shown in FIG. 7B), post-shaped electrical contacts 1408*a* and 1408*b* become lodged in the portion of channels 801*a* and 801*b* that curve toward rim 802 of ceiling mount 800, and thereby secure fan tower device 1400 to ceiling mount 800. In order to remove fan tower device 1400 from ceiling mount 800 (which is mounted to the ceiling through ceiling base 300), fan tower device 1400 is pushed toward ceiling mount 800 and then rotated until post-shaped electrical contacts 1408*a* and 1408*b* enter the elongated sections of channels 801*a* and 801*b*, at which point fan tower device 1400 can be easily separated from ceiling mount 800 (as shown in FIG. 7C). The electrically-powered components (motor, indicator lights, etc.) of fan tower device 1400 are powered by rechargeable battery 1402, when fan tower device 1400 is mated with ceiling mount 800 (which is in turn mounted to ceiling base 300). Fan tower device 1400 may be mated with floor base 900 in the same manner bladeless fan device 700 is mated with floor base 900 (as described above). Electricity flows through the electrical wiring of floor base 900 and eventually into rechargeable battery 1402.

Figures 8A, 8B, 8C, 8D:
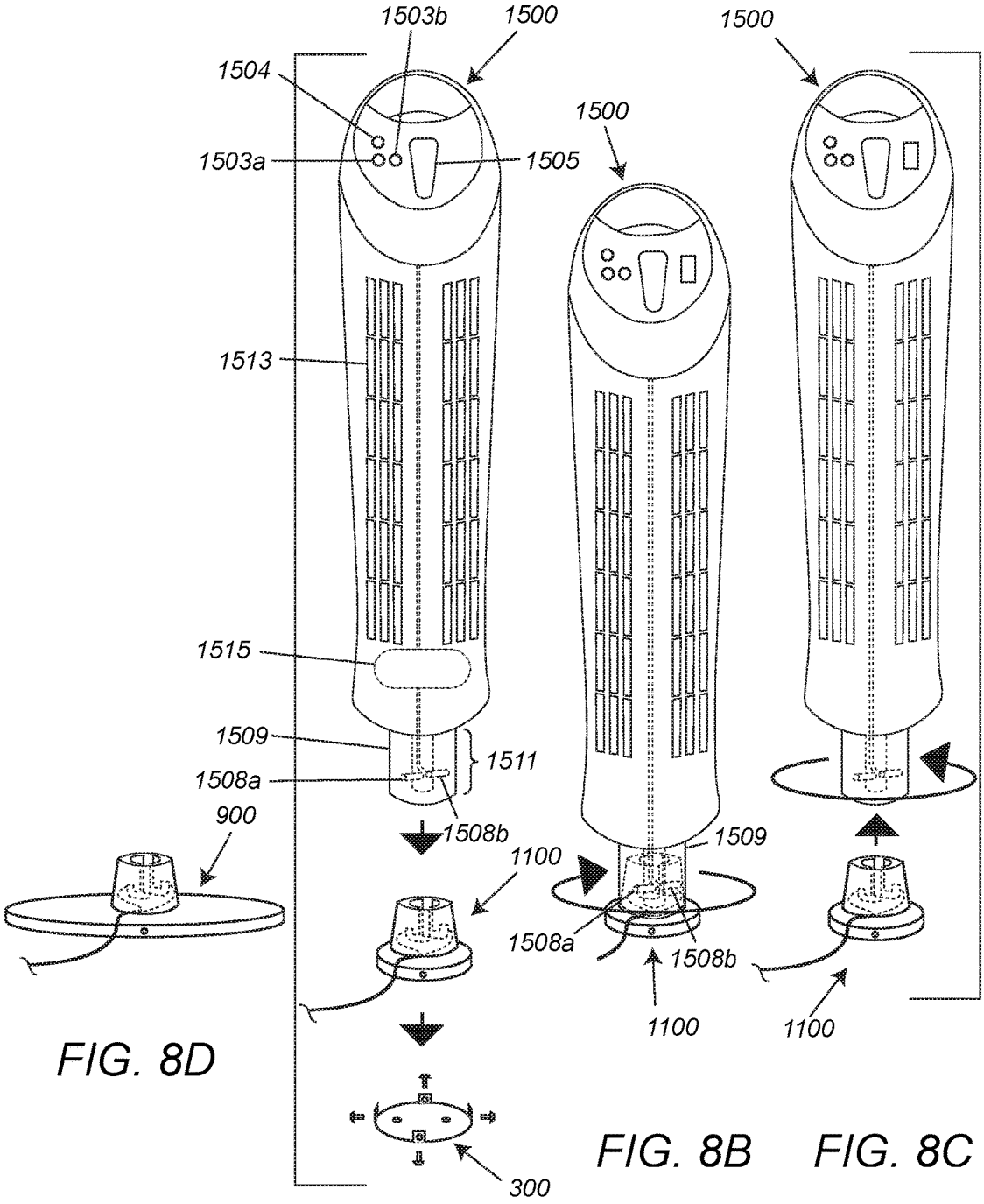
FIG. 8A depicts, in accordance with an embodiment of the invention, fan tower device 1500, which is placed over ceiling mount 1100, which is in turn connected to ceiling base 300. Fan tower device 1500 operates through AC power whether mounted to the ceiling through ceiling mount 1100 or the floor through floor base 900 (FIG. 8D).
FIG. 8B depicts, in accordance with an embodiment of the invention, fan tower device 1500 as it is being twisted to mate with ceiling mount 1100 in the manner described above for FIG. 3C.
FIG. 8C depicts, in accordance with an embodiment of the invention, fan tower device 1500 being removed from ceiling mount 1100 in the manner described above for FIG. 3B.
FIG. 8D depicts, in accordance with an embodiment of the invention, floor base 900 (connected to a source of electricity (not shown)) which is designed to mate with fan tower device 1500 and provide electricity to the electrically-powered components (i.e., motor, indicator lights, etc.) of fan tower device 1500 when fan tower device 1500 is connected to floor base 900.

Fan tower device 1500 (FIG. 8A) moves air in the same manner as the other fan tower devices described above. Fan tower device 1500 includes fan speed buttons 1503*a* (increases amount of air displaced when depressed) and 1503*b* (decreases amount of air displaced when depressed), wireless remote sensor/receiver 1504, AC power and battery charge status indicator light 1505, electrical wiring (connecting to post-shaped electrical contacts 1508*a* and 1508*b* as well as motor 1515 of fan tower device 1500 and other electrically-powered components (e.g., battery charge status indicator light 1505, wireless remote sensor/receiver, etc.)), mounting cylinder 1509, and connecting section 1511. Ceiling mount 1100 depicted in FIG. 8A is configured to mount with fan tower device 1500 in the same way that ceiling mount 1100 mounts with bladeless fan device 1000 (as described above). Ceiling mount 1100 is designed to connect to ceiling base 300 in the same manner ceiling mount 200 connects with ceiling base 300 (as described above). Fan tower device 1500 can be removed from ceiling mount 1100 in the same manner in which bladeless fan device 1000 is removed from ceiling mount 1100, as described above. The electrically-powered components (motor, indicator lights, etc.) of fan tower device 1500 are powered by the electrical wiring of ceiling mount 1100 (as described above) when fan tower device 1500 is mated with ceiling mount 1100 (which is in turn mounted to ceiling base 300). Fan tower device 1500 may also be mated with floor base 900 in the same manner that bladeless fan device 700 is mounted with floor base 900 (described above). Because it does not have a rechargeable battery, fan tower device 1500 is powered by electricity delivered by ceiling mount 1100 or floor base 900, as described above.

Example 3

Detachable Bladed Fan Systems

The bladed fan devices and systems of the present invention operate in the manner of traditional floor fans by circulating air through rotating blades powered by a motor.

Figures 9A, 9B, 9C, 9D:
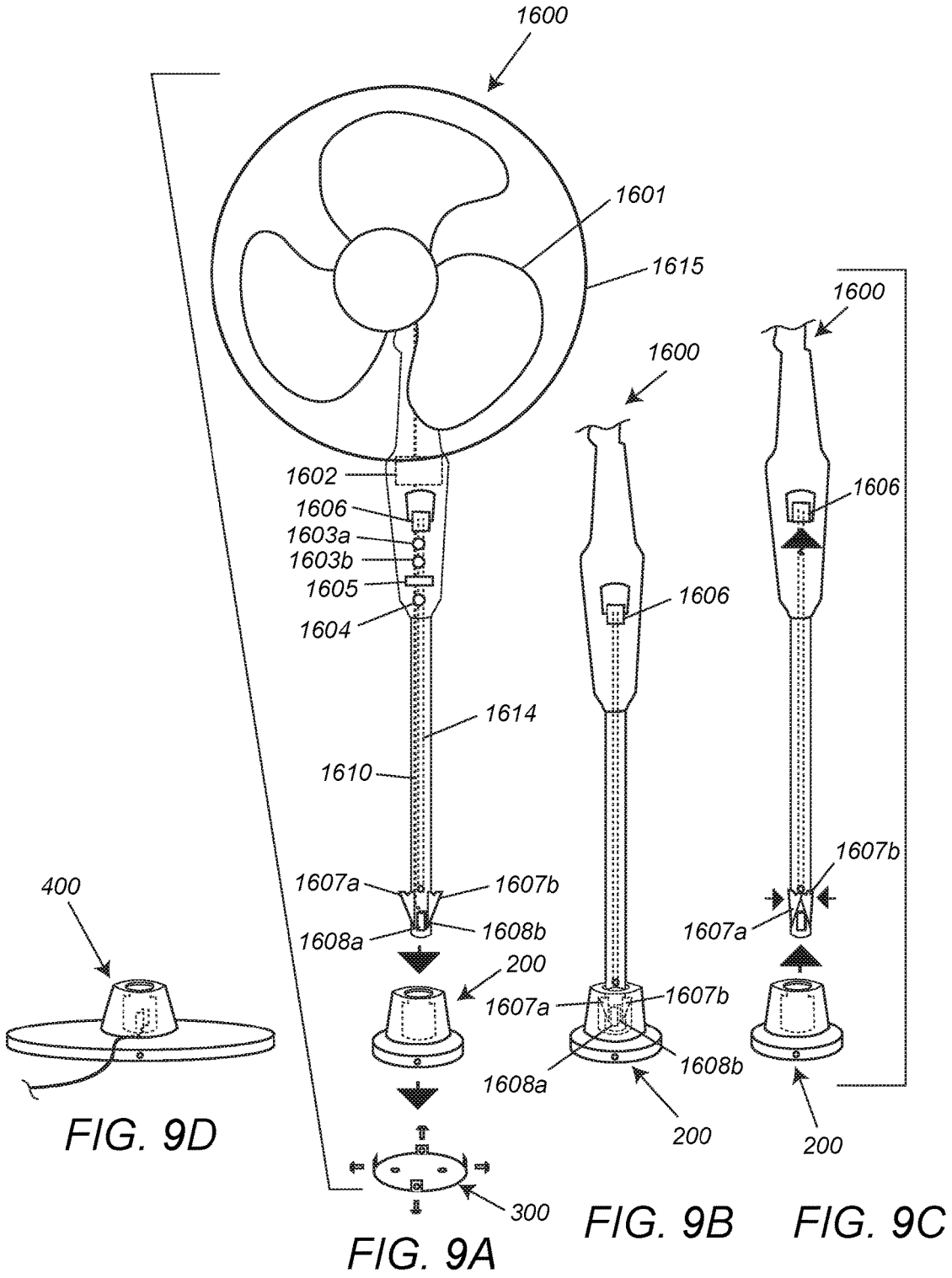
FIG. 9A depicts, in accordance with an embodiment of the invention, bladed fan device 1600, which is placed over ceiling mount 200, which is in turn connected to ceiling base 300. Bladed fan device 1600 operates through direct current (DC) supplied by a rechargeable battery when mounted to the ceiling through ceiling mount 200, and is charged by alternating current (AC) from a wall source when mounted on the floor through floor base 400 (FIG. 9D).
FIG. 9B depicts, in accordance with an embodiment of the invention, bladed fan device 1600 connected to ceiling mount 200.
FIG. 9C depicts, in accordance with an embodiment of the invention, bladed fan device 1600 as it is being removed from ceiling mount 200 in the manner described above for FIG. 5C.
FIG. 9D depicts, in accordance with an embodiment of the invention, floor base 400 (connected to a source of electricity (not shown)) which is designed to mate with bladed fan device 1600 and charge rechargeable battery 1602 when bladed fan device 1600 is connected to floor base 400.

FIG. 9A depicts bladed fan device 1600, which is placed into ceiling mount 200, which is in turn connected to ceiling base 300, which is in turn connected to the ceiling of a building (not shown). Bladed fan device 1600 includes blades 1601 that are designed to move air when rotated (in the manner of a traditional fan). Bladed fan device 1600 further includes: rechargeable battery 1602, fan speed buttons 1603*a* (increases amount of air displaced when depressed) and 1603*b* (decreases amount of air displaced when depressed), power indicator light 1604, AC power and battery charge status indicator light 1605, retractable and spring loaded wedges 1607*a* and 1607*b*, wedge retracting lever 1606, wedge connecting line 1614 mechanically connecting wedge retracting lever 1606 to retracting wedges 1607*a* and 1607*b*, electrical connectors/contacts 1608*a* and 1608*b*, electrical wiring 1610, and safety covering 1615 (enveloping fan blades, but shown as a single circle for clarity). Bladed fan device 1600 operates through direct current (DC) supplied by rechargeable battery 1602 when mounted to the ceiling through ceiling mount 200, and is charged by alternating current (AC) from a wall source when mounted on the floor through floor base 400 (FIG. 9D). Bladed fan device 1600 can be mated with ceiling mount 200 by placing the end containing retracting wedges 1607*a* and 1607*b* into ceiling mount 200. Retracting wedges 1607*a* and 1607*b* then become fixed into place (FIG. 9B) in the same manner as when bladeless fan device 100 is mated with ceiling mount 200 (as described above). Ceiling mount 200 is connected to ceiling base 300 as described herein above. In operation, battery 1602 is electrically connected to a motor that drives the function of bladed fan device 1600 and thereby displaces air in the room in which bladed fan device 1600 has been mounted according to the preceding steps. Battery 1602 also supplies power to all other electrically-powered components (i.e. indicator lights, etc.) of bladed fan device 1600. Battery 1602 is also connected to electrical wiring that terminates in electrical contacts 1608A and 1608B. As shown in FIG. 9C, fan tower device 1200 can be removed from ceiling mount 200 by sliding wedge retracting lever 1606 in the direction indicated by the arrow just below wedge retracting lever 1606. As wedge retracting lever 1606 slides in the direction indicated by said arrow, tension from wedge connecting line 1614 retracts wedges 1607*a* and 1607*b* inward, thereby allowing bladed fan device 1600 to separate from ceiling mount 200. After bladed fan device 1600 is separated from ceiling mount 200 (or before the two components are mated), bladed fan device 1600 can be mated with floor base 400 in much the same manner bladed fan device 1600 is mounted in ceiling mount 200. Electricity flows through the electrical wiring of floor base 400 and then through electrical wiring 1610 connected to rechargeable battery 1602. Thus, rechargeable battery 1602 can be charged by floor base 400.

When bladed fan device 1600 is connected to ceiling mount 200 (which is in turn connected to ceiling base 300, as described above), it relies on direct current from rechargeable battery 1602 for power, as ceiling mount 200 and ceiling base 300 are not associated with a power source. Because no electrical wires are associated with this type of powerless base, it can be mounted on practically any building structure, as described above. In contrast, as indicated above, floor base 400 is configured with electrical wiring connected to a power source. This type of powered base is configured to charge rechargeable battery 1602 and operate the motor (not shown) of the bladed fan device.

Figures 10A, 10B, 10C, 10D:
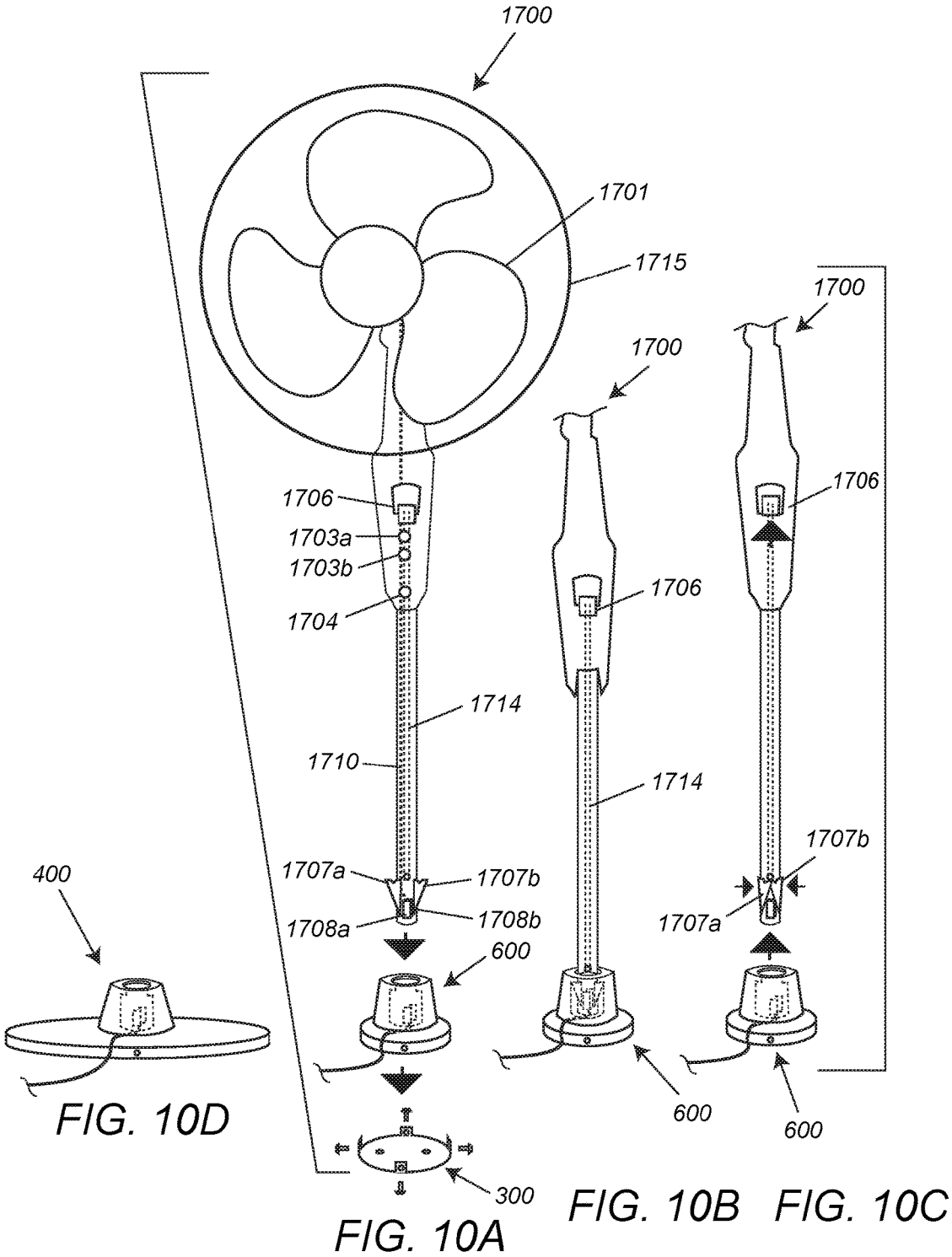
FIG. 10A depicts, in accordance with an embodiment of the invention, bladed fan device 1700, which is placed over ceiling mount 600, which is in turn connected to ceiling base 300. Bladed fan device 1700 operates through AC power whether mounted to the ceiling through ceiling mount 600 or the floor through floor base 400 (FIG. 10D).
FIG. 10B depicts, in accordance with an embodiment of the invention, bladed fan device 1700 connected to ceiling mount 600.
FIG. 10C depicts, in accordance with an embodiment of the invention, bladed fan device 1700 being removed from ceiling mount 600 in the manner described above for FIG. 9C.
FIG. 10D depicts, in accordance with an embodiment of the invention, floor base 400 (connected to a source of electricity (not shown)), which is designed to mate with bladed fan device 1700 and provide electricity to the electrically-powered components (i.e., motor, indicator lights, etc.) of bladed fan device 1700 when bladed fan device 1700 is connected to floor base 400.

FIG. 10A depicts bladed fan device 1700, which is placed into ceiling mount 600, which is in turn connected to ceiling base 300, which is in turn connected to the ceiling of a building (not shown). Bladed fan device 1700 includes blades 1701 designed to move air when rotated (in the manner of a traditional bladed fan). Bladed fan device 1700 further includes: fan speed buttons 1703*a* (increases amount of air displaced when depressed) and 1703*b* (decreases amount of air displaced when depressed), AC power and battery charge status indicator light 1704, retractable and spring loaded retracting wedges 1707*a* and 1707*b*, wedge retracting lever 1706, wedge connecting line 1714 (which mechanically connects wedge retracting lever 1706 to retracting wedges 1707*a* and 1707*b*), electrical connectors/contacts 1708*a* and 1708*b*, and electrical wiring 1710. Bladed fan device 1700 operates through alternating current (AC) supplied by electrically wired ceiling mount 600 (FIG. 10B), or electrically wired floor base 400 (FIG. 10D). As shown in FIG. 10C, bladed fan device 1700 can be separated from ceiling mount 600 in the same manner bladeless fan device 100 is separated from ceiling mount 200 (described above). Likewise, bladed fan device 1300 can be connected to floor base 400 in the same manner bladed fan device 1600 is connected to floor base 400 (described above). Ultimately, as bladed fan device 1700 does not have a rechargeable battery, it relies on AC power for operation, whether from ceiling mount 600, floor base 400, or another mount/base with a powered base configuration. Nevertheless, bladed fan device 1700 can be used as part of a modular fan system in which one or more powered bases are positioned in different locations, and bladed fan device 1700 can be removably connected to any of the powered bases, as desired.

Figures 11A, 11B, 11C, 11D:
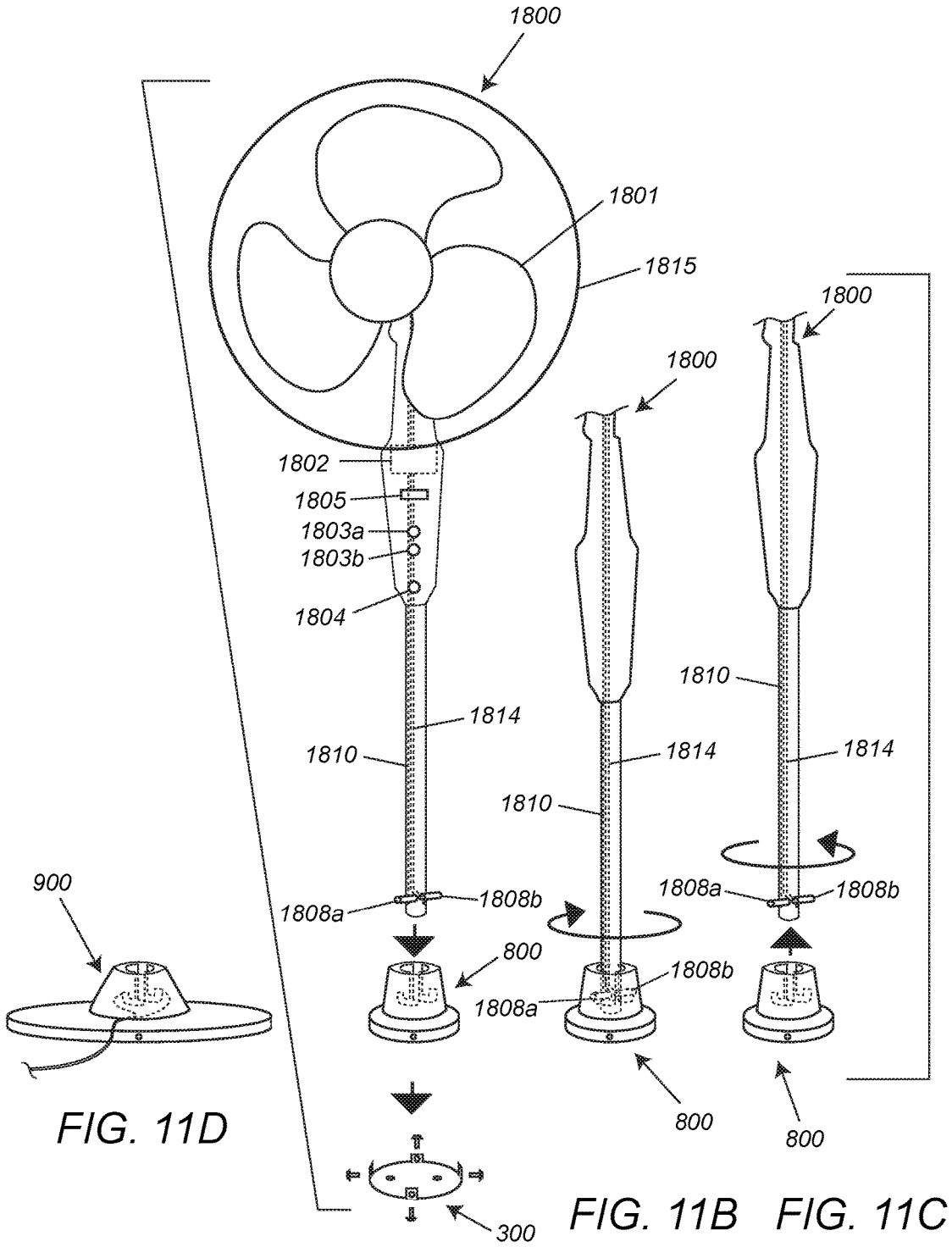
FIG. 11A depicts, in accordance with an embodiment of the invention, bladed fan device 1800, which is placed over ceiling mount 800, which is in turn connected to ceiling base 300. Bladed fan device 1800 operates through direct current (DC) supplied by a battery when mounted to the ceiling through ceiling mount 800, and is charged by alternating current (AC) from a wall source when mounted on the floor through floor base 900 (FIG. 11D).
FIG. 11B depicts, in accordance with an embodiment of the invention, bladed fan device 1800 connected to ceiling mount 800.
FIG. 11C depicts, in accordance with an embodiment of the invention, bladed fan device 1800 being removed from ceiling mount 800 in the manner described above for FIG. 8C.
FIG. 11D depicts, in accordance with an embodiment of the invention, ceiling mount 900 (connected to a source of electricity (not shown)), which is designed to mate with bladed fan device 1800 and charge the rechargeable battery 1802 of bladed fan device 1800 when ceiling mount 900 is connected to bladed fan device 1800.

Bladed fan device 1800 (FIG. 11) includes fan blades 1801 (which function in the manner of a typical fan blade), rechargeable battery 1802, fan speed buttons 1803*a* (increases amount of air displaced when depressed) and 1803*b* (decreases amount of air displaced when depressed), wireless remote sensor/receiver 1804, AC power and battery charge status indicator light 1805, electrical wiring 1810 (connecting from post-shaped electrical contacts 1808*a* and 1808*b* to rechargeable battery 1802. The post-shaped electrical contacts of bladed fan device 1800 are designed to interact with the channels of ceiling mount 800 in the same manner as post-shaped electrical contacts of fan tower device 1400 interact with channels 801*a* and 801*b* of ceiling mount 800, as described above. Ceiling mount 800 is designed to connect to ceiling base 300 in the same manner ceiling mount 200 connects with ceiling base 300 (as described above). Bladed fan 1800 is removed from ceiling mount 800 (FIG. 11C), in the same manner as fan tower device 1400 is removed from ceiling mount 800 (as described above). The electrically-powered components (motor, indicator lights, etc.) of bladed fan device 1800 are powered by rechargeable battery 1802, when bladed fan device 1800 is mated with ceiling mount 800 (which is in turn mounted to ceiling base 300). Bladed fan device 1800 may be mated with floor base 900 (FIG. 11D) in essentially the same manner that bladeless fan device 700 is mated with floor base 900 (as described above). Electricity flows through the electrical wiring of floor base 900 and eventually into rechargeable battery 1802.

Figures 12A, 12B, 12C, 12D:
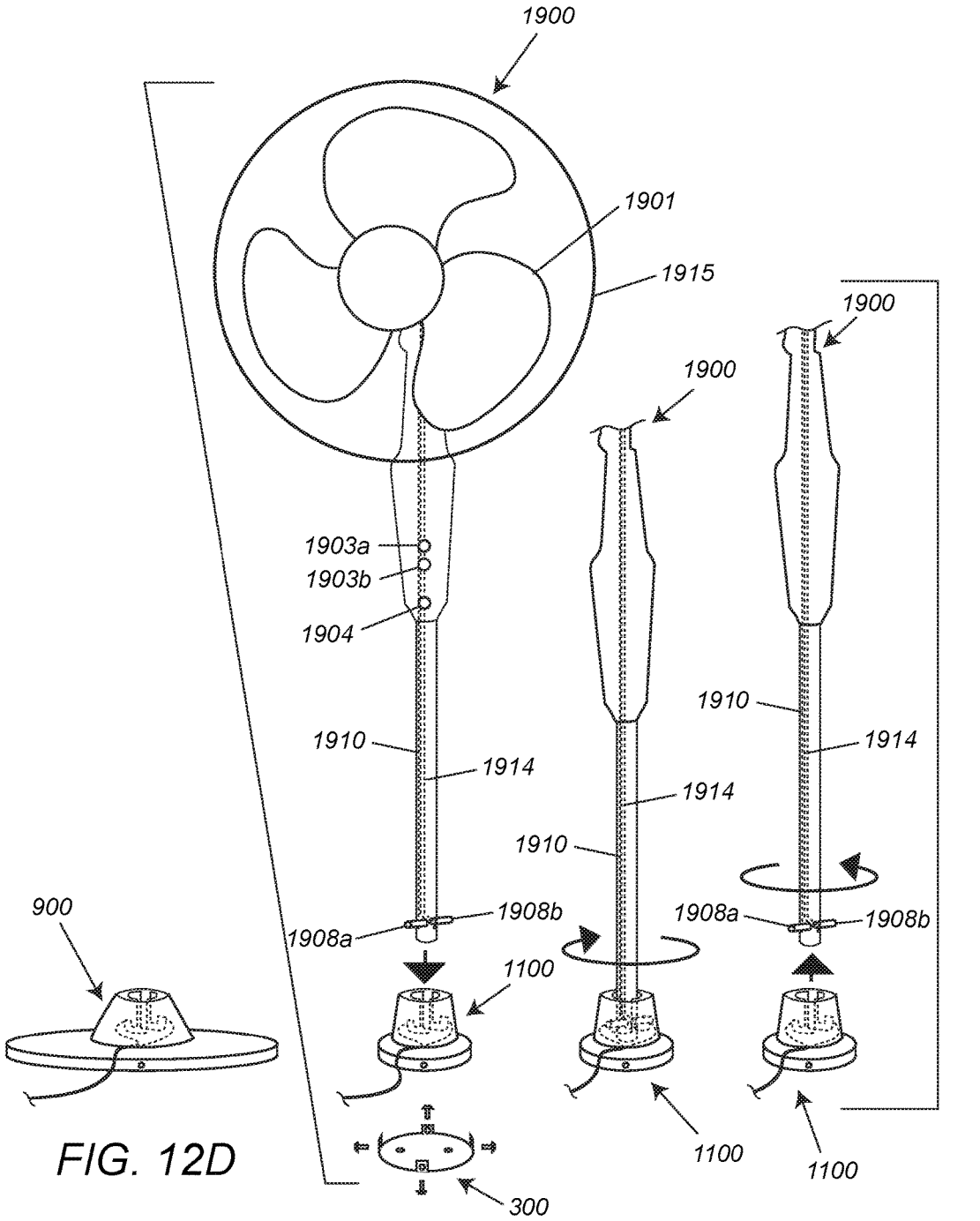
FIG. 12A depicts, in accordance with an embodiment of the invention, bladed fan device 1900, which is placed over ceiling mount 1100, which is in turn connected to ceiling base 300. Bladed fan device 1900 operates through AC power whether mounted to the ceiling through ceiling mount 11 or the floor through floor base 900 (FIG. 12D).
FIG. 12B depicts, in accordance with an embodiment of the invention, bladed fan device 1900 connected to ceiling mount 1100.
FIG. 12C depicts, in accordance with an embodiment of the invention, bladed fan device 1900 as it is being removed from ceiling mount 1100 in the manner described above for FIG. 11C.
FIG. 12D depicts, in accordance with an embodiment of the invention, floor base 900 (connected to a source of electricity (not shown)) which is designed to mate with bladed fan device 1900 and provide electricity to the electrically-powered components (i.e., motor, indicator lights, etc.) of bladed fan device 1900 when bladed fan device 1900 is connected to floor base 900.

Bladed fan device 1900 (FIG. 12) includes: blades 1901 (which operate in the manner of typical fan blades), fan speed buttons 1903*a* (increases amount of air displaced when depressed) and 1903*b* (decreases amount of air displaced when depressed), wireless remote sensor/receiver 1904, and electrical wiring 1910 (connecting to post-shaped electrical contacts 1908*a* and 1908*b* as well as the motor (not shown) of bladed fan device 1900 and other electrically-powered components (e.g. wireless remote sensor/receiver, etc.)). Ceiling mount 1100 depicted in FIG. 12A is configured to mount with bladed fan device 1900 in essentially the same way that ceiling mount 1100 mounts with bladeless fan device 1000 (as described above). Ceiling mount 1100 is designed to connect to ceiling base 300 in the same manner ceiling mount 200 connects with ceiling base 300 (as described above). Bladed fan device 1900 can be removed from ceiling mount 1100 in the same manner in which bladeless fan device 1000 is removed from ceiling mount 1100, as described above. The electrically-powered components (motor, indicator lights, etc.) of bladed fan device 1900 are powered by the electrical wiring of ceiling mount 1100 (as described above) when bladed fan device 1900 is mated with ceiling mount 1100 (which is in turn mounted to ceiling base 300). Bladed fan device 1900 may also be mated with floor base 900 (FIG. 12D) in the same manner that bladeless fan device 700 is mounted with floor base 900 (described above). Because it does not have a rechargeable battery, bladed fan device 1900 is powered by electricity delivered by ceiling mount 1100 or floor base 900, as described above.

Example 4

Portable Charging Systems

Figure 13:
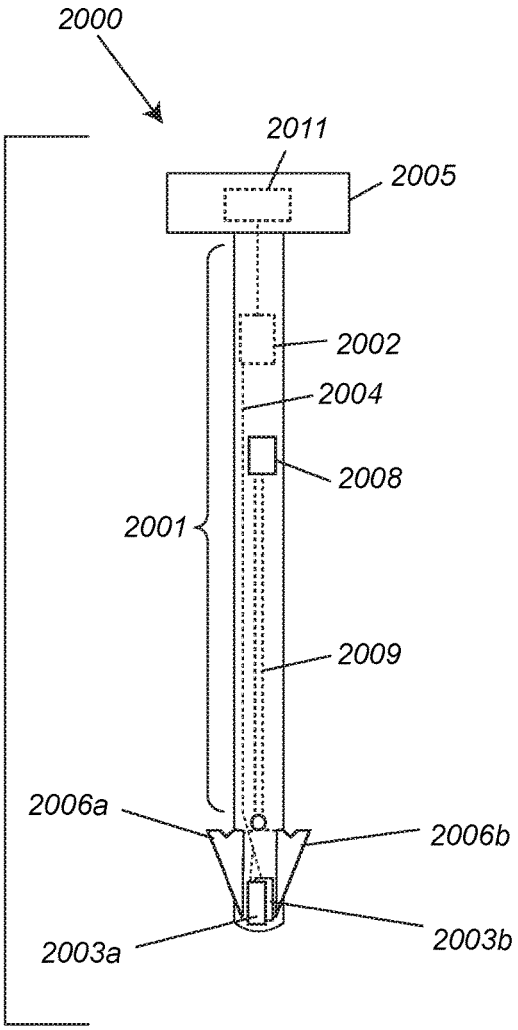
FIG. 13 depicts, in accordance with an embodiment of the invention, electrically powered device 2000, which includes charging post 2001, which houses vertically oriented rechargeable battery 2002.

The powered floor bases described in various embodiments above (e.g. floor base 400 and floor base 900) are designed to power and/or charge various fan devices described herein, so that the charged devices can be subsequently mounted in a mounting station that does not provide electricity. While the examples provided above all relate to various types of fans, the same general concept can be applied to charge a rechargeable battery located within any electrically powered device by docking the device with a wired floor mount, and then subsequently moving the electrically powered device to a separate mount that is not electrically wired (i.e. does not provide electricity). Merely by way of non-limiting example, as shown in FIG. 13, electrically powered device 2000 includes charging post 2001, which houses vertically oriented rechargeable battery 2002. Vertically oriented rechargeable battery 2002 is connected by electrical wiring 2010 to electrical contacts 2003*a* and 2003*b* on one end, and to electrical wiring 2004 on the other end. Electrical wiring 2004 is connected to the electrically powered elements 2011 of electrically powered component 2005. Wedge components 2006*a* and 2006*b* are associated with mating cylinder 2007. Charging post 2001 further includes wedge retracting lever 2008 and wedge retracting line 2009, which is connected to wedge components 2006*a* and 2006*b*. Wedge retracting lever 2008, wedge retracting line 2009, wedge components 2006*a* and 2006*b*, electrical wiring 2010, and electrical contacts 2003*a* and 2003*b* function in the same manner as the analogous components depicted in FIG. 9A. Electrically powered component 2005 can be any of a number of electrically powered components, including but in no way limited to a light, an air purifier, an ionizer, a stereo, a CD player, a DVD player, a movie projector, a television, and the like. Charging post 2001 of electrically powered device 2000 can be mated with floor base 400 in the same manner as bladeless fan device 100 mates with floor base 400 (see FIG. 1D). Charging post 2001 of electrically powered device 2000 can likewise be mated with ceiling mount 200 (which can in turn be mated with ceiling base 300) in the same manner bladeless fan device 100 is mounted to ceiling mount 200. In operation, the rechargeable battery of electrically powered device 2000 can be charged by docking charging post 2001 to floor base 400, which is in turn connected to a source of electricity. Electricity flows to the rechargeable battery of electrically powered device 2000, which in turn provides electricity to the electrically powered components of electrically powered device 2000. Thus, the rechargeable battery can be charging while the electrically powered device is operating. Advantageously, when the rechargeable battery 2002 of electrically powered device 2000 is charged, electrically powered device 2000 can be can be removed from floor base 400 and mated with ceiling mount 200. Electrically powered device 2000 can be mated with ceiling mount 200 in the same manner as bladeless fan device 100 is mounted to ceiling mount 200.

Figure 14:
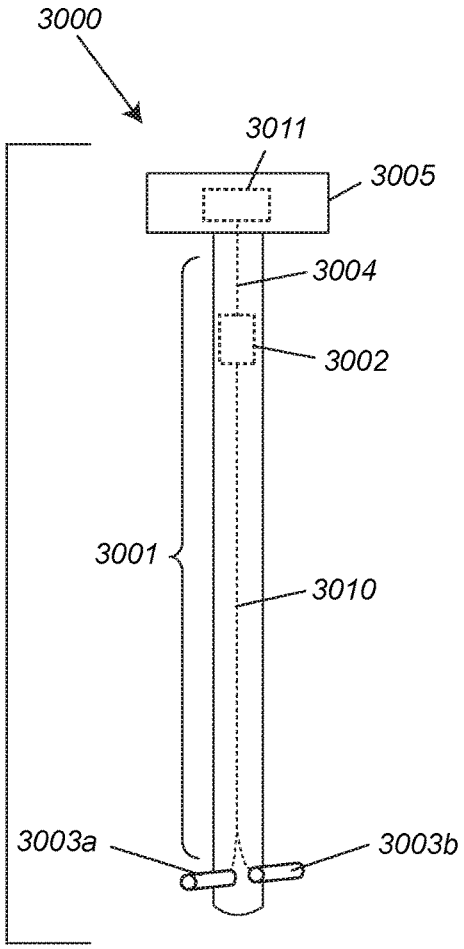
FIG. 14 depicts, in accordance with an embodiment of the invention, electrically powered device 3000, which includes charging post 3001, which houses vertically oriented rechargeable battery 3002.

FIG. 14 depicts electrically powered device 3000, which includes charging post 3001, which houses vertically oriented rechargeable battery 3002. Vertically oriented rechargeable battery 3002 is connected by electrical wiring 3010 to post-shaped electrical contacts 3003*a* and 3003*b* on one end, and to electrical wiring 3004 on the other end. Electrical wiring 3004 is connected to electrically powered elements 3011 of electrically powered component 3005. Electrically powered component 3005 can be any of a number of electrically powered components, including but in no way limited to a light, an air purifier, an ionizer, a stereo, a CD player, a DVD player, a movie projector, a television, and the like. Charging post 3001 of electrically powered device 3000 can be mated with floor base 900 in the same manner as bladeless fan device 700 mates with floor base 900 (see FIG. 3D and description above). Charging post

3001 of electrically powered device 3000 can likewise be mated with ceiling mount 800 (which can in turn be mated with ceiling base 300) in the same manner bladeless fan device 700 is mounted to ceiling mount 800 (see FIGS. 3A and 3C). In operation, the rechargeable battery 3002 of electrically powered device 3000 can be charged by mating charging post 3001 to floor base 900, which is in turn connected to a source of electricity. Electricity flows to the rechargeable battery of electrically powered device 3000, which in turn provides electricity to the electrically powered elements 3011 of electrically powered device 3000. Thus, the rechargeable battery can be charging while the electrically powered device is off or operating. Advantageously, when the rechargeable battery 3002 of electrically powered device 2000 is charged, electrically powered device 3000 can be can be removed from floor base 900 and mated with ceiling mount 800. Electrically powered device 3000 can be mated with ceiling mount 800 in the same manner as bladeless fan device 700 is mounted to ceiling mount 800.

FIG. 15 depicts electrically powered device 4000, which includes charging post 4001, which houses vertically oriented rechargeable battery 4002. Vertically oriented rechargeable battery 4002 is connected by electrical wiring 4010 to electrical contacts 4003*a* and 4003*b* on one end, and by electrical wiring 4013 to electrical contacts 4004*a* and 4004*b* on the other end. Electrical contacts 4004*a* and 4004*b* can be mated with electrical contacts 4012*a* and 4012*b* which are in turn connected to wiring 4014 that is connected to electrically powered elements 4011 of electrically powered component 4005. In this way, the cylindrical end of charging post 4001 can be separated from cylindrical end of electrically powered component 2005 (these two sections are connected by a latch mechanism (not shown), but could be connected by any attaching mechanism known in the art). Wedge components 4006*a* and 4006*b* are associated with cylinder 4007. Charging post 4001 further includes wedge retracting lever 4008 and wedge retracting line 4009. Electrically powered component 4005 can be any of a number of electrically powered components, including but in no way limited to a light, an air purifier, an ionizer, a stereo, a CD player, a DVD player, a movie projector, a television, and the like. Charging post 4001 of electrically powered device 4000 can be mated with floor base 400 in the same manner as bladeless fan device 100 mates with floor base 400 (see FIG. 1D). Charging post 4001 of electrically powered device 4000 can likewise be mated with ceiling mount 200 (which can in turn be mated with ceiling base 300) in the same manner bladeless fan device 100 is mounted to ceiling mount 200. In operation, the rechargeable battery of electrically powered device 4000 can be charged by mating charging post 4001 to floor base 400, which is in turn connected to a source of electricity. Electricity flows to the rechargeable battery 4002 of electrically powered device 4000, which in turn provides electricity to the electrically powered components 4011 of electrically powered device 4000. Thus, the rechargeable battery 4002 can be charging while the electrically powered device is off or operating. Advantageously, when the rechargeable battery 4002 of electrically powered device 4000 is charged, electrically powered device 4000 can be can be removed from floor base 400 and mated with ceiling mount 200. Electrically powered device 4000 can be mated with ceiling mount 200 in the same manner as bladeless fan device 100 is mounted to ceiling mount 200.

FIG. 16 depicts electrically powered device 5000, which includes charging post 5001, which houses vertically oriented battery 5002. Vertically oriented rechargeable battery 5002 is connected by electrical wiring 5010 to post-shaped electrical contacts 5003*a* and 5003*b* on one end, and by electrical wiring 5013 to electrical contacts 5004*a* and 5004*b* on the other end. Electrical contacts 5004*a* and 5004*b* can be mated with electrical contacts 5010*a* and 5010*b* which are in turn connected to wiring 5014 that is connected to electrically powered elements 5011 of electrically powered component 5005. Electrically powered component 5005 can be any of a number of electrically powered components, including but in no way limited to a light, an air purifier, an ionizer, a stereo, a CD player, a DVD player, a movie projector, a television, and the like. Charging post 5001 of electrically powered device 5000 can be mated with floor base 900 in the same manner as bladeless fan device 700 mates with floor base 900 (see FIG. 3D). Charging post 5001 of electrically powered device 5000 can likewise be mated with ceiling mount 800 (which can in turn be mated with ceiling base 300) in the same manner bladeless fan device 700 is mounted to ceiling mount 800 (see FIG. 3A). In operation, the rechargeable battery of electrically powered device 5000 can be charged by docking charging post 5001 to floor base 900, which is in turn connected to a source of electricity. Electricity flows to the rechargeable battery of electrically powered device 5000, which in turn provides electricity to the electrically powered components of electrically powered device 5000. Thus, the rechargeable battery can be charging while the electrically powered device is operating. Advantageously, when the rechargeable battery 5002 of electrically powered device 5000 is charged, electrically powered device 5000 can be can be removed from floor base 900 and mated with ceiling mount 800. Electrically powered device 5000 can be mated with ceiling mount 800 in the same manner as bladeless fan device 700 is mounted to ceiling mount 800.

The various methods and techniques described above provide a number of ways to carry out the invention. Of course, it is to be understood that not necessarily all objectives or advantages described can be achieved in accordance with any particular embodiment described herein. Thus, for example, those skilled in the art will recognize that the methods can be performed in a manner that achieves or optimizes one advantage or group of advantages as taught herein without necessarily achieving other objectives or advantages as taught or suggested herein. A variety of alternatives are mentioned herein. It is to be understood that some embodiments specifically include one, another, or several features, while others specifically exclude one, another, or several features, while still others mitigate a particular feature by inclusion of one, another, or several advantageous features.

Furthermore, the skilled artisan will recognize the applicability of various features from different embodiments. Similarly, the various elements, features and steps discussed above, as well as other known equivalents for each such element, feature or step, can be employed in various combinations by one of ordinary skill in this art to perform methods in accordance with the principles described herein. Among the various elements, features, and steps some will be specifically included and others specifically excluded in diverse embodiments.

Although the application has been disclosed in the context of certain embodiments and examples, it will be understood by those skilled in the art that the embodiments of the application extend beyond the specifically disclosed embodiments to other alternative embodiments and/or uses and modifications and equivalents thereof.

In some embodiments, the terms "a" and "an" and "the" and similar references used in the context of describing a particular embodiment of the application (especially in the context of certain of the following claims) can be construed to cover both the singular and the plural. The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (for example, "such as") provided with respect to certain embodiments herein is intended merely to better illuminate the application and does not pose a limitation on the scope of the application otherwise claimed. No language in the specification should be construed as indicating any non-claimed element essential to the practice of the application.

Certain embodiments of this application are described herein, including the best mode known to the inventors for carrying out the application. Variations on those embodiments will become apparent to those of ordinary skill in the art upon reading the foregoing description. It is contemplated that skilled artisans can employ such variations as appropriate, and the application can be practiced otherwise than specifically described herein. Accordingly, many embodiments of this application include all modifications and equivalents of the subject matter recited in the claims appended hereto as permitted by applicable law. Moreover, any combination of the above-described elements in all possible variations thereof is encompassed by the application unless otherwise indicated herein or otherwise clearly contradicted by context.

All patents, patent applications, publications of patent applications, and other material, such as articles, books, specifications, publications, documents, things, and/or the like, referenced herein are hereby incorporated herein by this reference in their entirety for all purposes, excepting any prosecution file history associated with same, any of same that is inconsistent with or in conflict with the present document, or any of same that may have a limiting affect as to the broadest scope of the claims now or later associated with the present document. By way of example, should there be any inconsistency or conflict between the description, definition, and/or the use of a term associated with any of the incorporated material and that associated with the present document, the description, definition, and/or the use of the term in the present document shall prevail.

In closing, it is to be understood that the embodiments of the application disclosed herein are illustrative of the principles of the embodiments of the application. Other modifications that can be employed can be within the scope of the application. Thus, by way of example, but not of limitation, alternative configurations of the embodiments of the application can be utilized in accordance with the teachings herein. Accordingly, embodiments of the present application are not limited to that precisely as shown and described.

What is claimed is:

1. A modular fan system, comprising an air displacing device configured to displace air from a first location to a second location, the air displacing device comprising:

a internal power source; and a first locking component;

a first docking station configured to stand on a surface of a floor, wherein the first docking station comprises:

an electrical connector to connect to an external power source;

a port configured to transfer power from the external power source to the internal power source of the air displacing device; and a second locking component configured to removably attach to the first locking component of the air displacing component, wherein the first docking station is configured to hold the air displacing device in first vertical position with a top of the air displacing device pointing upward; and a second docking station configured to attach to a ceiling or wall, the third docking station comprising a third locking component configured to removably attach to the first locking component, wherein the second docking station is configured to hold the air displacing device in second vertical position with the top of the air displacing device pointing downward.

2. The modular fan system of claim 1, wherein the second docking station is configured to attach to a structure of a building.

3. The modular fan system of claim 1, wherein the first docking station is a fan mount.

4. The modular fan system of claim 1, wherein the first docking station is a floor base.

5. The modular fan system of claim 1, wherein the internal power source is a rechargeable battery electrically connected to a motor that drives the air displacing device.

6. The modular fan system of claim 1, wherein the first locking component comprises a first electric contact and the second locking component comprise a second electric contact, wherein the first electric contact is configured to transfer energy to the second electric contact to charge the internal power source.

7. The modular fan system of claim 1, wherein:

the second docking station is not connected to a source of electricity; and a motor of the air displacing device is configured to operate using power from the internal power source when the air displacing device is connected to the second fan docking station.

8. The modular fan system of claim 1, wherein the first locking component comprises:

a first wedge and a second wedge configured to connect to the second locking component; and a wedge retracting lever to detach the first wedge and the second wedge from the second locking component.

9. The modular fan system of claim 1, wherein the first locking component comprises two spring loaded wedges that are lodged into the second locking component.

10. The modular fan system of claim 1, wherein the first locking component comprises two post-shaped electrical contacts that are configured to attach to two complimentary channels in the second locking component.

11. An apparatus comprising an elongated electrically powered device comprising a rechargeable battery;

an air displacing device configured to displace air from a first location to a second location;

a locking component configured to removably attach to a docking station, wherein the docking station is configured to hold the air displacing device in a first position; and an integrated stand configured to hold the air displacing device in a second position.

12. The apparatus of claim 11, wherein the elongated electrically powered device further comprises a port configured to receive power from the docking station and relay the power to the rechargeable battery.

13. The apparatus of claim 11, wherein the docking station is removably connected to the locking component.

14. The apparatus of claim 11, wherein the integrated stand is configured to hold the air displacing device in the first position on a substantially flat surface.

15. The apparatus of claim 11, wherein the docking station comprises:

a first spring loaded wedge configured to connect to a first portion of the locking component;

a second spring loaded wedge configured to connect to a second portion of the locking component; and a wedge retracting lever to detach the first spring loaded wedge and the second spring loaded wedge from the locking component.

16. The apparatus of claim 11, wherein the elongated electrically powered device is removably attached to the docking station via two post-shaped electrical contacts that are lodged in two complimentary channels in the docking station.

17. A system, comprising an air displacing device configured to displace air, the air displacing device comprising:

a internal power source; and a first locking component at a bottom of the air displacing device;

a first docking station comprising a second locking component configured to removably attach to the first locking component of the air displacing device, wherein the first locking component is configured to electrically couple to the internal power source via the first locking component and the second locking component; and a second docking station comprising a third locking component configured to removably attach to the first locking component of the air displacing device, wherein the first docking station is configured to hold the air displacing device in a first position and the second docking station is configured to hold the air displacing device in a second position.

18. The system of claim 17, wherein the second position is approximately 180 degrees opposite to the first position.

19. The system of claim 17, wherein:

the first position is a first vertical position with a top of the air displacing device pointing upward; and the second position is a second vertical position with the top of the air displacing device pointing downward.

20. The system of claim 17, wherein the second docking station is not configured to electrically couple to the first locking component.

* * * * *